US006347875B1

(12) United States Patent
Painsith

(10) Patent No.: US 6,347,875 B1
(45) Date of Patent: Feb. 19, 2002

(54) FUNCTIONAL PART HOLDER, ESPECIALLY A PENKNIFE

(75) Inventor: Hermann Painsith, Klagenfurt (AT)

(73) Assignee: Victorinox AG, Ibach (CH)

( * ) Notice: Subject to any disclaimer, the term of this patent is extended or adjusted under 35 U.S.C. 154(b) by 0 days.

(21) Appl. No.: 09/485,330

(22) PCT Filed: Aug. 7, 1998

(86) PCT No.: PCT/AT98/00184

§ 371 Date: Mar. 30, 2000

§ 102(e) Date: Mar. 30, 2000

(87) PCT Pub. No.: WO99/07247

PCT Pub. Date: Feb. 18, 1999

(30) Foreign Application Priority Data

Aug. 8, 1997 (DE) ..... 297 14 180 U
May 18, 1998 (AT) ..... 846/98

(51) Int. Cl.[7] ..... B43K 29/10; B43K 29/18

(52) U.S. Cl. ..... 362/119; 362/118; 7/160; 401/109

(58) Field of Search ..... 362/118, 119, 362/120, 154–156, 234, 253, 116, 200, 201; 15/436, 437; 7/118, 158, 160; 101/109, 111, 112, 113, 114

(56) References Cited

U.S. PATENT DOCUMENTS

| | | | | | |
|---|---|---|---|---|---|
| 3,863,062 | A | | 1/1975 | Caron | 362/116 |
| 4,478,330 | A | * | 10/1984 | Lin | 206/38 |
| 4,516,325 | A | * | 5/1985 | Cohen | 362/119 |
| 4,678,356 | A | | 7/1987 | Garland | 401/95 |
| 4,807,744 | A | | 2/1989 | Chiou | 206/214 |
| 4,918,775 | A | * | 4/1990 | Leu | 362/119 |
| 5,048,989 | A | * | 9/1991 | Stageman | 401/109 |
| 5,168,780 | A | * | 12/1992 | Van Gennep | 362/119 |
| 5,402,575 | A | | 4/1995 | Maxcy | 30/123 |
| 5,459,647 | A | * | 10/1995 | Betts | 362/119 |
| 5,511,262 | A | * | 4/1996 | Horng | 7/160 |
| 5,568,741 | A | * | 10/1996 | Parsons | 7/118 |
| 5,584,380 | A | | 12/1996 | Naitou | 200/315 |
| 5,652,587 | A | * | 7/1997 | Liu | 362/119 |

FOREIGN PATENT DOCUMENTS

| | | |
|---|---|---|
| DE | 24 14 317 A | 10/1975 |
| DE | 39 08 960 A | 9/1990 |
| EP | 0 306 461 A | 3/1989 |
| WO | WO 94 09951 A | 5/1994 |
| WO | WO 97 19856 A | 6/1997 |

* cited by examiner

*Primary Examiner*—Alan Cariaso
(74) *Attorney, Agent, or Firm*—Alston & Bird LLP

(57) ABSTRACT

The invention relates to an implement holder, in particular for a pocket knife, or a flat-design storage case having a housing body with one or more housing compartments for at least one implement which can be moved out from a rest position into a position of use, e.g. a knife, corkscrew, screwdriver. A writing instrument is provided as an implement and the housing body projects beyond the implement forming the handle thereof in a ready-to-use position.

20 Claims, 17 Drawing Sheets

2
3
6
8
9
36
128
129
131
133
134
136
139
141
146
147
148
152
157
169
170
172
173
174
175
176
177
178
179
180
181
182
183
184
185
186
187
188
189
190
191
192
193
194
195
196
197
198
199
200
201
202
203
204
205
206
207
208
209
210
211
213
214
216
217
218
219
220

FUNCTIONAL PART HOLDER, ESPECIALLY A PENKNIFE

The invention relates to an implement holder as described in claims 1 and 10 and to a pocket knife as described in claim 30.

An implement holder is already known from WO 97/19856 A, in particular a storage case for holding articles of daily use and/or consumer articles comprising a housing body of flat-design with one or more housing compartments for implements enclosed at least in certain areas by a bottom plate and/or a cover plate extending parallel therewith. The housing compartments are accessible from the outside by means of housing openings, one housing compartment having a writing instrument arranged therein as the implement. However, the disadvantage of this is that the writing instrument has to be completely removed from the housing compartment before it can be used and, because of the desire to save space, the implements, and in particular the writing instrument, are of a small design which makes them awkward to handle and above all to use. In addition, the implement holder does not have a light source which means that it can not be used unless lighting conditions are satisfactory, making the use thereof totally impossible in situations of this type.

The objective of the invention is to provide an implement holder and a pocket knife, which will facilitate handling of the implements, particularly during use.

The objective of the invention is achieved by the characteristics outlined in claim 1. The surprising advantage resulting from these characterising features resides in the fact that when the implement is in the position in which it is used, projecting out from the housing body, the housing body forms the handle of the implement, in particular the writing instrument, making use of the implement significantly easier. Consequently, although considerably less space is needed to store the implement, a more adequate system can be found since a shorter design can be used than would be the case if it were used separately from the housing body.

There is an advantage to be had from another embodiment specified in claim 2, in which the number of individual components is reduced, thereby reducing manufacturing and assembly requirements.

Also advantageous is the embodiment set out in claim 3, in which the implement holder can be pre-assembled, in particular with the implements.

A practical design is described in claim 4, enabling the implements to be stored safely and in a space-saving arrangement.

Another embodiment specified in claim 5 has an advantage in that the implements can be stored in a certain order, thereby facilitating handling still further.

The embodiment of claim 6 has an advantage in that assembly of the implement holder is further simplified.

Claim 7 describes one option of providing a simple means of making the implement both easy to use and preventing it from working loose from the housing compartment.

The embodiment described in claim 8 offers an option whereby an implement that is fully integrated in one housing compartment can be inserted in another compartment so that it is ready to use in a position in which it projects beyond the external dimensions of the implement holder.

Another embodiment described in claim 9 offers an advantage in that the implement holder and the implements can be handled in poor lighting conditions, particularly in darkness.

The objective set by the invention is also achieved by the features described in claim 10. The surprising advantage offered by the characterising features of claim 10 is the fact that the implements can be used even under unsatisfactory conditions of visibility, in particular in darkness, making use of the implements significantly easier.

The designs described in claims 11 and 12 provide a surprisingly simple and compact structure for the implement holder.

An embodiment such as that described in claim 13 has an advantage in that a power circuit can be produced in a simple manner, which avoids the risk of faulty connection.

A practical embodiment is described in claim 14 which obviates the need for a long power lead, thereby reducing energy consumption.

An advantage of another embodiment described in claim 15 is that there is no need for an external power lead, so that the implement holder lends itself to a broader range of applications.

The embodiment described in claim 16 is also advantageous, however, because use of the implement, in particular the writing instrument, is facilitated due to the fact that the working range in which the implement is used, in particular the writing area, is illuminated.

The embodiments outlined in claims 17 and 18 make the implement even easier to use because the longitudinal guide member can be simultaneously used to locate the implement.

Practical embodiments are described in claims 19 and 20 and provide a simple means of locating the implement, thereby preventing the implement from moving of its own accord in an undesirable manner.

Another possible embodiment is that of claim 21, which allows an implement to be replaced, for example a spent ball-point pen, in a simple manner and without any awkward manoeuvring since from the adjustable position it can be removed from the compartment simply by overcoming the retaining force of the retaining device and then replaced therein.

Another embodiment described in claim 22 makes for easy use even under unfavourable conditions, for example if it is very wet.

There are advantages to an embodiment as specified in claim 23 since additional individual elements can be recessed, thereby making the best possible use of the space.

An embodiment as outlined in claim 24 is advantageous since the operating element is prevented from slipping into undesirable positions.

The design described in claim 25 represents a simple means of preventing the operating element from working loose of its own accord.

Other possible embodiments are those of claims 26 and 27, which facilitate access to the housing compartments and hence the implements.

The embodiment described in claim 28 prevents the implements from inadvertently falling out of the housing compartments, thereby ensuring that the implements are not lost.

The embodiment described in claim 29 allows the implement holder to be stored in a space-saving arrangement, for example in the credit-card compartment of wallets, organisers, briefcases and the like.

The objective of the invention is also achieved however by the features described in claim 30.

The surprising advantage resulting from the features of the characterising part lies in the fact that the pocket knife has a writing function, which is characterised by its extremely simple and rapid assembly and in that it can be manufactured inexpensively. The reason for this is on the one hand the small number of parts used, namely a slide and a conventional pen, and on the other hand the functional integration of the already existing shell as the slide housing.

In a preferred embodiment according to claim 31, when the shell has been taken apart the slide can be inserted easily into the longitudinal slot and by mounting the shell on a plate of the pocket knife the functionality of the slide is also ensured.

A development according to claim 32 has the advantage that a reliable writing function is ensured when the slide is advanced and shockproof securing is ensured in the retracted end position.

According to a particularly advantageous embodiment according to claim 33 the refill is easy to replace, to substitute empty cartridges for example or to use refills of different colours and stroke widths.

A development according to claim 34 is advantageous in that a simple but functionally reliable securing of the refill to the slide is ensured.

A design according to claim 35 is also advantageous in that a bend-free guiding of the cartridge is achieved.

An embodiment according to claim 36 has the advantage that the writing function of the pocket knife can be performed ergonomically and comfortably.

An advantageous embodiment is described in claim 37 as a result of which a particularly good grip is achieved.

By means of an embodiment according to claim 38 the actuating element can be locked comfortably in the two end positions of the slide.

An embodiment according to claim 39 is also possible however, whereby the actuating element after the elastic deformation of a shaft along a cam formed on the shell is displaceable between the two end positions.

A development according to claim 40 is also advantageous, whereby with a corresponding arrangement of the spring element on the one hand the refill can be removed easily and on the other hand the latter can be secured in the withdrawn end position.

Lastly, an embodiment according to claim 41 is possible, whereby for example by means of injection moulding rapid and inexpensive manufacture is achieved.

To provide a clearer understanding of the invention, an explanation will be given below of the embodiments illustrated in the appended drawings.

Of these:

Figure 1:
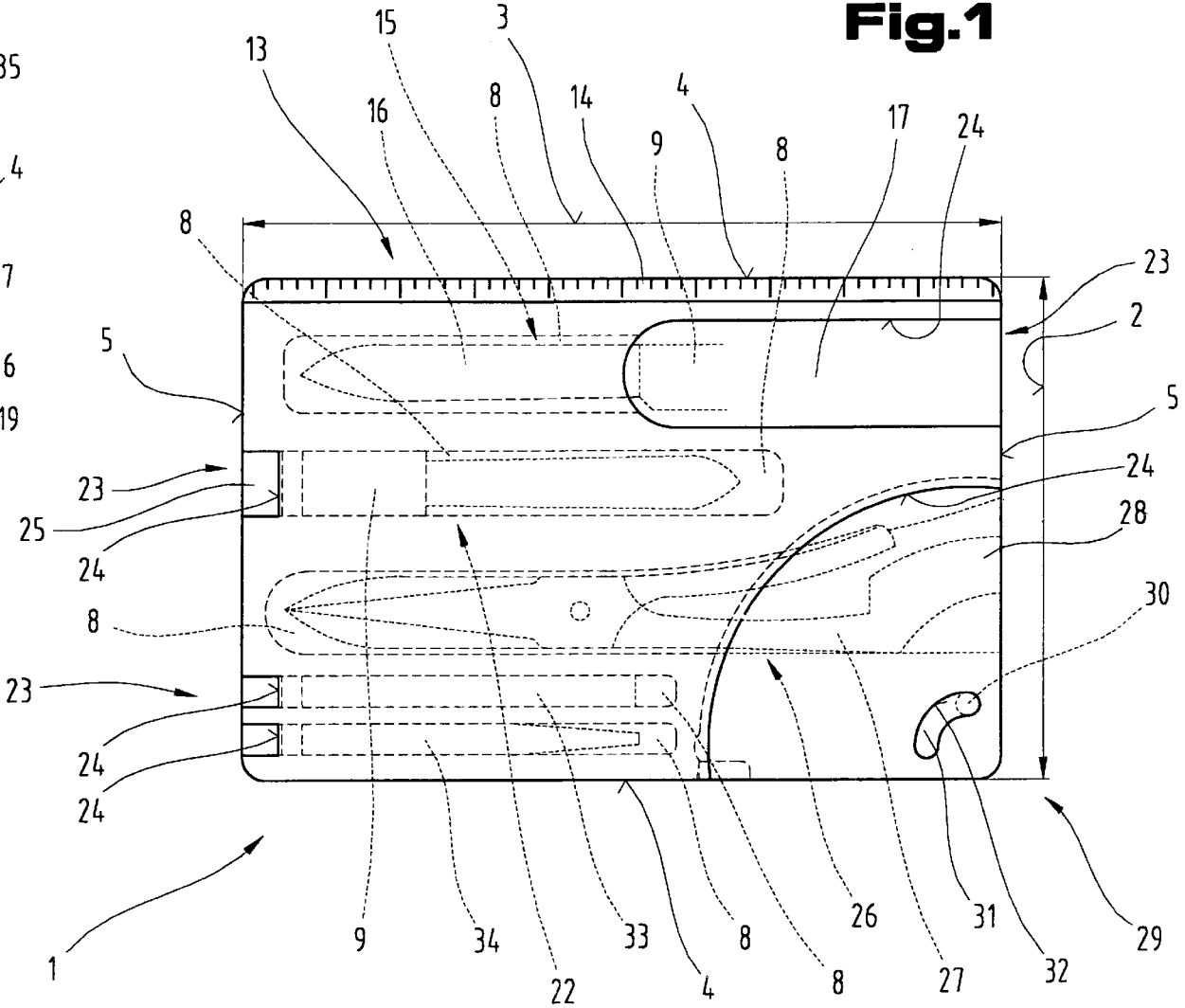
FIG. 1 is an implement holder as proposed by the invention, in particular a housing body in the form of a storage case of a flat design, seen in a plan view.

Firstly, it should be pointed out that the same parts in the different embodiments described are denoted by the same reference numerals and the same component names, so that the explanations given throughout the entire description can be transferred in terms of meaning to common parts with the same reference numerals and the same component names. Details of positions given throughout the description, e.g. top, bottom, side, etc., and referring to the different drawings can also be transferred and where a different view is shown transposed in terms of meaning to the new position. Furthermore, individual features or combinations of features from the different embodiments described and illustrated can be considered in their own right as solutions of or objects proposed by the invention.

Figure 2:
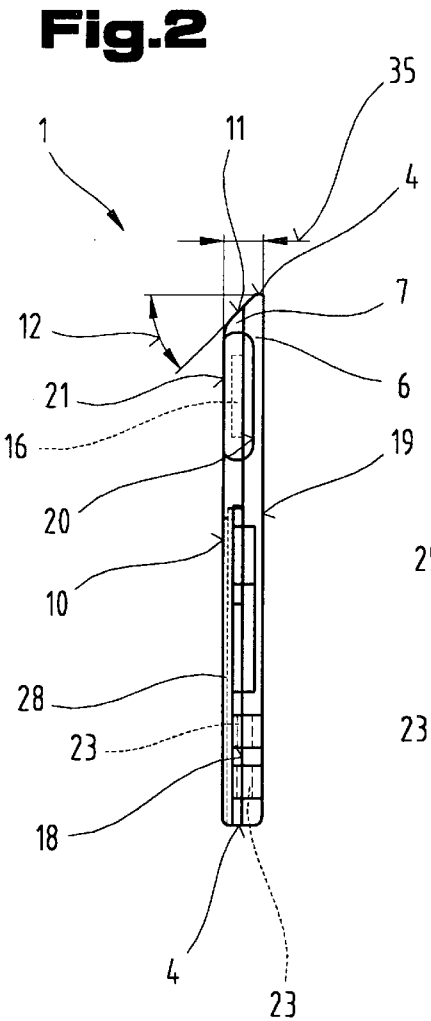
FIG. 2 shows the implement holder proposed by the invention in a side view.

FIGS. 1 and 2, which will be described together, illustrate an implement holder, in particular a housing body 1 of a flat design providing a storage case, made from metal or plastic, being rectangular in plan view with a width 2 and a length 3 measured perpendicular thereto. The width 2 represents a distance between two parallel longitudinal end faces 4, extending perpendicular to transverse end faces 5 spaced at a distance apart by the length 3. The housing body 1 has a bottom plate 6 and a cover plate 7, which are detachably or non-detachably joined to one another. The longitudinal end faces 4 and transverse end faces 5 also preferably extend perpendicular to the bottom plate 6 and to the cover plate 7. Extending from the oppositely lying transverse end faces 5 are internally lying housing compartments 8, in which objects, in particular implements 9, but also consumer articles, are arranged.

One longitudinal end face 4 is joined to a top face 10 of the cover plate 7 extending approximately perpendicular thereto by means of an inclined surface 11, which extends at an incline from the longitudinal end face 4 in a direction towards the top face 10 and the second longitudinal end face 4 at an angle of inclination 12. However, the second longitudinal end face 4 and/or the transverse end faces 5 or at least parts of the longitudinal end faces 4 and transverse end faces 5 could also be arranged inclined relative to the bottom and/or cover plate 6 and 7 and thereby form the inclined face 1. The inclined face 11 or a region of the bottom plate 6 and/or cover plate 7 co-operating therewith will have a scale 13 here, in particular a rule 14.

Extending adjacent to the inclined face 11 is a housing compartment 8 for an implement 9, a knife 15 in this case, the knife blade 16 being enclosed by the bottom plate 6 and the cover plate 7 in a direction extending perpendicular to the top face 10. However, a knife handle 17 is arranged in a recessed depression 20 standing out from a bottom face 19 of the bottom plate 6 running in a direction towards the top face 10 remote from a connecting face 18 of the bottom plate 6 with the cover plate 7 and parallel therewith and is therefore enclosed only in the direction of the bottom face 19 by means of the bottom plate 6. Accordingly, the housing compartment 8 for the implement 9, i.e. for the knife 15, is enclosed by the bottom plate 6 and at least across a certain part by the cover plate 7 extending parallel therewith. The knife handle 17 has a gripping surface 21, which runs approximately parallel with and flat along the top face 10.

Arranged adjacent to the knife 15 and in the direction opposite the scale 13 is another housing compartment 8, for example for a file 22. This is enclosed in the direction of the top face 10 and the bottom face 19 by the cover plate 7 and the bottom plate 6, so that a compartment opening 23 for the file 22 is arranged in the transverse end face 5, through which it can be inserted in the housing compartment 8. The cover plate 7 has a rectangular recess 24, which projects out from the transverse end face 5 in the direction of the transverse end face 5 remote therefrom and in which a file handle 25 is so arranged that it is accessible from the outside via the recess 24. This makes it easy to get hold of the file 22 so that it can be readily inserted in and removed from the housing compartment 8. As a result, a part region of the housing compartment 8 is made accessible by means of the recess 24, in the same manner as the arrangement provided for getting hold of the knife handle 17, and which can also be arranged in the bottom plate 6.

Extending adjacent to the housing compartment 8 for the file 22 is the housing compartment 8 for clippers 26, provided as another implement 9, which runs from the transverse end face 5 in the direction of the transverse end face 5 remote therefrom. A clipper handle 27 of the clippers 26 and a recess 24 of the cover plate 6 extending in an arcuate shape is covered in the direction of the top face 10 by means of a hinged plate 28, so that the recess opening 23 for the clippers 26 is enclosed by the bottom plate 6 and the cover plate 7 in the direction of the bottom face 19 and the top face 10. The hinged plate 28 is therefore mounted in a hinge mounting 31 in a corner region 29 of the storage case 1 by means of a hinge pin 30 extending perpendicular to the top face 10 and bottom face 19, preferably being of a cylindrical design. For example, this may be provided as a curved cam track 32. The hinge pin 30 may be secured in the hinge recess 31 by means of a fixing ring to prevent any axial movement.

Extending parallel with one another and with the longitudinal end face 4 and adjacent to the housing compartment 8 for the clippers 26 are two housing compartments 8, used for storing implements 9, in particular tweezers 22 and a tooth pick 34. Each of these can be inserted in the housing compartments 8 by means of a compartment opening 23 in the transverse end face 5. It would also be possible to provide a recess 24, such as that provided for the file handle 25, in the region of the transverse end face 5 for both the handle of the tweezers 33 and the handle of the tooth pick 34. The top face 10 is spaced apart from the bottom face 19 by a thickness 35 of the storage case 1, which is preferably of a rectangular design. The length 3, like the width 2, forms a multiple of the thickness 35 of the storage case 1, so that the dimensions of the storage case 1 substantially match the dimensions of a credit card and can therefore be kept in conventional housing compartments such as those provided in wallets, briefcases or organisers. In addition, practical experience has shown that the thickness 35 of the storage case 1 can be made smaller if the length 3 is increased. It would be possible to arrange all the compartment openings 23 of the housing compartments 8 on one transverse end face 5 or longitudinal end face 4. However, there are more advantages to be had if the compartment openings 23, for example for the clippers 26 and the knife 15, are on one transverse end face 5 and the compartments openings 23 for the file 22, the tweezers 33 and toothpicks 34 are arranged in a transverse end face 5 remote therefrom.

A plane of symmetry of the implement 9 and/or the consumer article and/or the housing compartment 8 extending parallel with the bottom plate 6 and/or cover plate 7 is offset from a plane of symmetry of the storage case 1 running parallel with the bottom plate 6 and/or cover plate 7, which bisects the thickness 35, in a direction perpendicular to the bottom plate 6 and/or cover plate 7. Alternatively, it may be that the hinged plate 28 and a part of the bottom plate 6 and/or the cover plate 7 do not swivel but are movable relative to at least one housing compartment and/or slidably or pivotably mounted in a plane containing the bottom plate 6 and/or the cover plate 7. Furthermore, a cross-section measurement of at least a part of a housing compartment 8 can be adapted to the cross-section of the shape of the implement and/or consumer article to allow a slight tolerance, which will then allow it to be held in the housing compartment 8 in a friction fit. This being the case, the surface roughness of the housing compartment 8 and/or the implement 9 and/or the consumer article can be made to have a higher degree of surface roughness in a retaining region, which may be the entire housing compartment 8.

A peripheral end-face edge of the implement 9 and/or the consumer article, delimited by the outer contour thereof, is oriented approximately perpendicular with respect to the bottom plate 6 and/or cover plate 7. The implement 9 and/or consumer article will have a gripping part projecting beyond its external periphery, such as the file handle 25 of the file 22 for example, which is arranged in the recess 24 and can also be retained in the recess by means of a friction fit. As mentioned above, the storage case is made in two parts, so that the bottom plate 6 and/or cover plate 7 can be formed by a single-piece flat cutting. However, it would also be possible to retain the cover plate 7 spaced at a distance apart from the bottom plate 6 primarily by means of the central part delimiting the housing compartments 8 and join them by means of joining means, in particular a bonded or welded seam. The hinged plate 28 may have a locating projection in the region of a curved end face and projecting out therefrom which engages in a locating recess of an implement 9, such as the clippers 26 for example, preventing it from inadvertently working loose. Clearly, the housing body 1 may also be made as one integral element, for example as an injection-moulded component, in which case the housing compartments 8 for the implements 9 and/or consumer articles could already be formed by means of dies during the injection moulding process.

Figure 3:
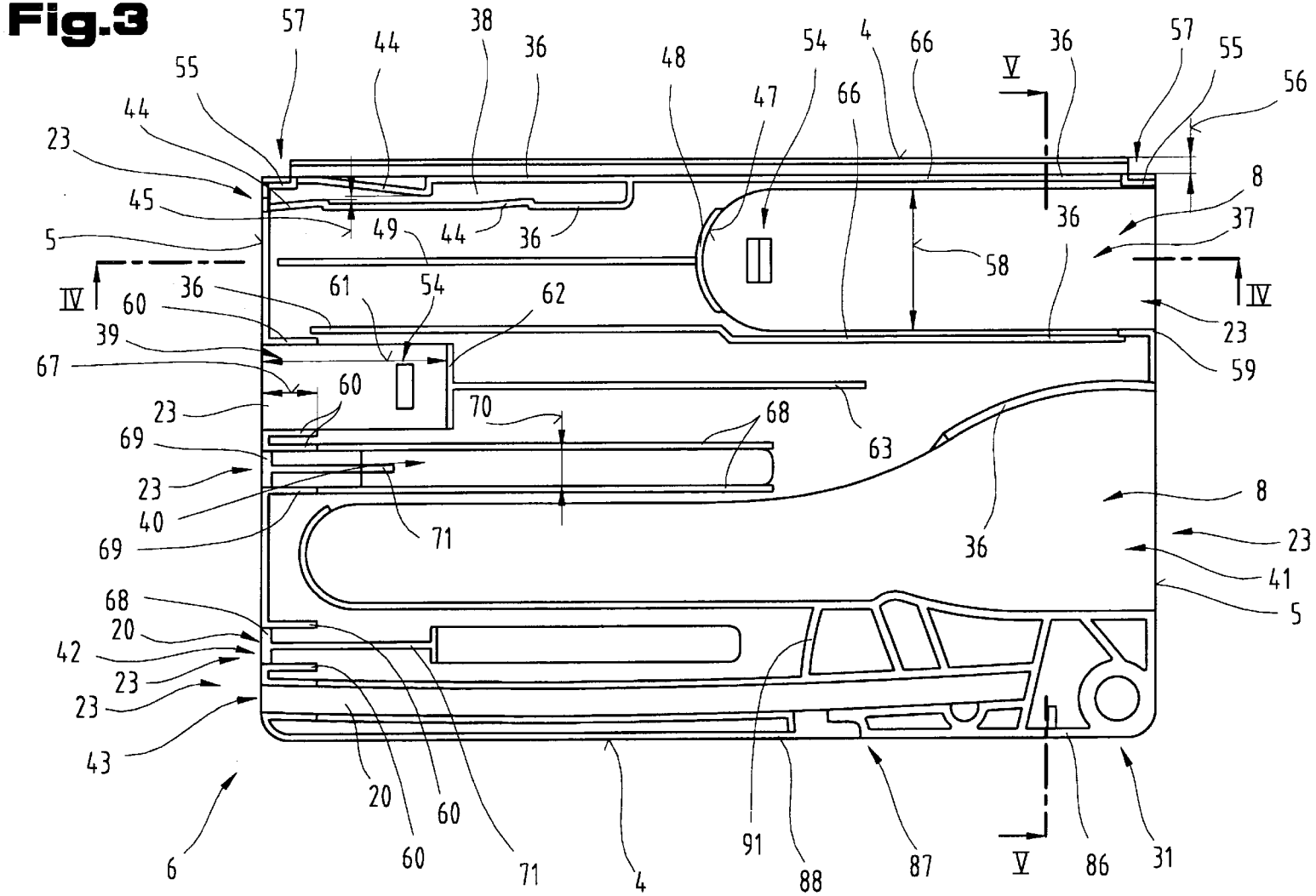
FIG. 3 illustrates an implement holder as proposed by the invention, in particular the bottom plate of the housing body, shown in a plan view.
Figure 4:
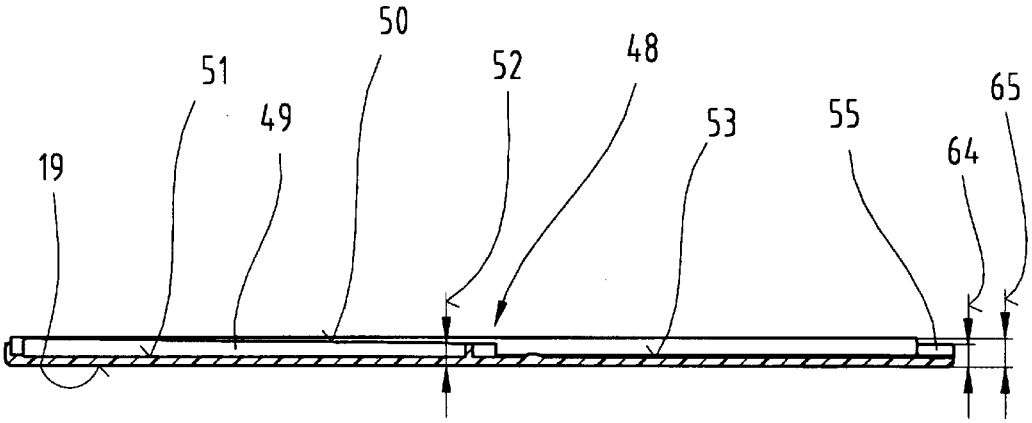
FIG. 4 depicts the implement holder in a section along the lines IV—IV of FIG. 3.
Figure 5:
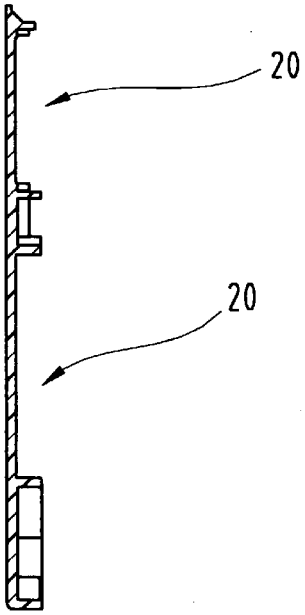
FIG. 5 depicts the implement holder in a section along the lines V—V of FIG. 3.

FIGS. 3 to 5 illustrate the bottom plate 6 in more detail. The part-regions of the housing compartments 8 formed by the recessed depressions 20 are at least partially, i.e. in part-regions of implements 9 not illustrated, enclosed or formed by ridges 36, which are arranged on the bottom plate 6 and/or cover plate 7. The recessed depressions 20 therefore provide a recessed depression for a knife 37, a recessed depression for a needle 38, a recessed depression for a file 39, a recessed depression for tweezers 40, a recessed depression for clippers 41, a recessed depression for tooth picks 42 in the design of the recessed depression 20 for an implement 9 illustrated in FIG. 1 which is used for tooth picks 34 and a recessed depression for a ball-point pen 43, which is also formed by a recessed depression 20. Ridges 36 for the recessed depression for a needle 38 are defined by lengths of part-ridges 44 aligned facing one another running at an angle relative to the transverse end face 5 and spaced apart from one another by the depression width 45 measured parallel with the transverse end face 5. The depression width 45 is smaller than a diameter of a needle 46, not illustrated, to be inserted in the recessed depression for a needle 38.

When the needle 46 is inserted in the recessed depression for a needle 38, it is retained in a friction fit by means of the angularly extending part-ridges 44 in such a way that as the needle 46 is inserted in the recessed depression for a needle 38 it is deflected by means of the first part-ridge 44 arranged adjacent to the transverse end face 5 onto the part-ridge 44 lying opposite, from where it is directed back away to the part-ridge 44 arranged at the farthest distance from the transverse end face 5. Consequently, the needle 46 is elastically deformed in the recessed depression for a needle 38, so that the needle is retained in the recessed depression for a needle 38 of its own accord.

The recessed depression for a knife 37, in particular the part-region thereof which is used to accommodate the knife handle 17, not illustrated, has a stop ridge 48 forming a curved face 47 which prevents the knife handle 17 from penetrating farther in the direction of the compartment opening 23 for the needle 46. Adjoining the stop ridge 48 is a clamp ridge 49 preferably extending parallel with the longitudinal end face 4, in the direction towards the insertion opening 23 for the needle 46. As can be seen from FIG. 4, this forms a clamp face 50 running at an incline to a base surface 51 which is preferably parallel with the bottom face 19. In the region of the stop ridge 48, the clamp face 50 is spaced back by a height 52, which becomes larger in the direction of the transverse end face 5 incorporating the insertion opening 23 for the needle 46. Arranged on a depression base 53 of the recessed depression for the knife 37 is a retaining shoulder 54, which projects away from the depression base 53 towards the bottom face 19. Arranged in the region of the compartment opening 23 of the recessed depression for the knife 37 running parallel with the longitudinal end face 4 is a centring ridge 55, which is arranged set back from the longitudinal end face 4 by a width of free region 56, measured perpendicular thereto, of a free region 57 arranged in the corner region between the longitudinal end face 4 and the transverse end face 5. Ridges 36 for the recessed depression for the knife 37, in particular in the region of the knife handle 17, running parallel with one another and with the longitudinal end face 4, are arranged spaced apart from one another by a width measured parallel with the transverse end face 5 which is greater than a depression width 58.

Adjacent to the recessed depression for the clippers 41, the compartment opening 23 of the recessed depression for the knife 37 has a centring ridge 59 extending perpendicular to the transverse end face 5. The longitudinal end face 4 also has, in a corner region between it and the transverse end face 5 incorporating the compartment opening 23 for the needle 46, a free region 57 with a centring ridge 55.

The compartment opening 23 of the housing compartment 8 for the file 22, not illustrated, is also arranged in the transverse end face 5 incorporating the compartment opening 23 for the needle 46. The recessed depression for the file 39 also has a retaining shoulder 54 and is delimited in the region of the compartment opening 23 by centring ridges 60, which run perpendicular to the transverse end face 5. At a depth 61 measured perpendicular to the transverse end face 5, a stop ridge 62 runs parallel with the transverse end face 5 and arranged adjoining it is a clamp ridge 63 disposed perpendicular to the transverse end face 5. The centring ridges 55 are—as can be seen in FIG. 4—of a centring ridge height 64 rising at a right-angle above the depression base 53 and in the direction away from the bottom face 19. The centring ridge height 64 is therefore smaller than the ridge height 65 of the longitudinal ridges 66 measured parallel therewith.

Running in a region between the recessed depression for the file 39 and the recessed depression for the clippers 41 is the recessed depression for the tweezers 40. The compartment opening 23 of the recessed depression for the tweezers 40 is partially bounded by two centring ridges 60 running parallel with one another and perpendicular to the transverse end face 5. As is the case with those partially bordering the recessed depression for the file 39, these run from the transverse end face 5 to a ridge length 67 which delimits the centring ridges 60 in a direction aligned perpendicular to the centring ridges 60. Adjoining the ridge length 67, longitudinal ridges 68 extend perpendicular to the transverse end face 5 and flush with the centring ridges 60. These are bounded in the direction opposite the bottom face 19 by means of a ridge height, measured perpendicular to the depression base 53, which is higher than the centring ridge height 64 measured parallel therewith. In the direction towards the bottom face 19, the compartment opening 23 of the recessed depression for the tweezers 40 is also bounded by a cross ridge 69, which runs across an entire depression width 70 of the recessed depression for the tweezers 40 and which has a cross ridge height smaller than that of the centring ridge height 64 . A clamp ridge 71 running parallel with the longitudinal ridges 68 extends from the cross ridge 69, bisecting the depression width 70.

The compartment opening 23 for the recessed depression for the clippers 41 is located in the transverse end face 5 remote from the transverse end face 5 incorporating the compartment opening 23 for the needle 46, for example.

Figure 6:
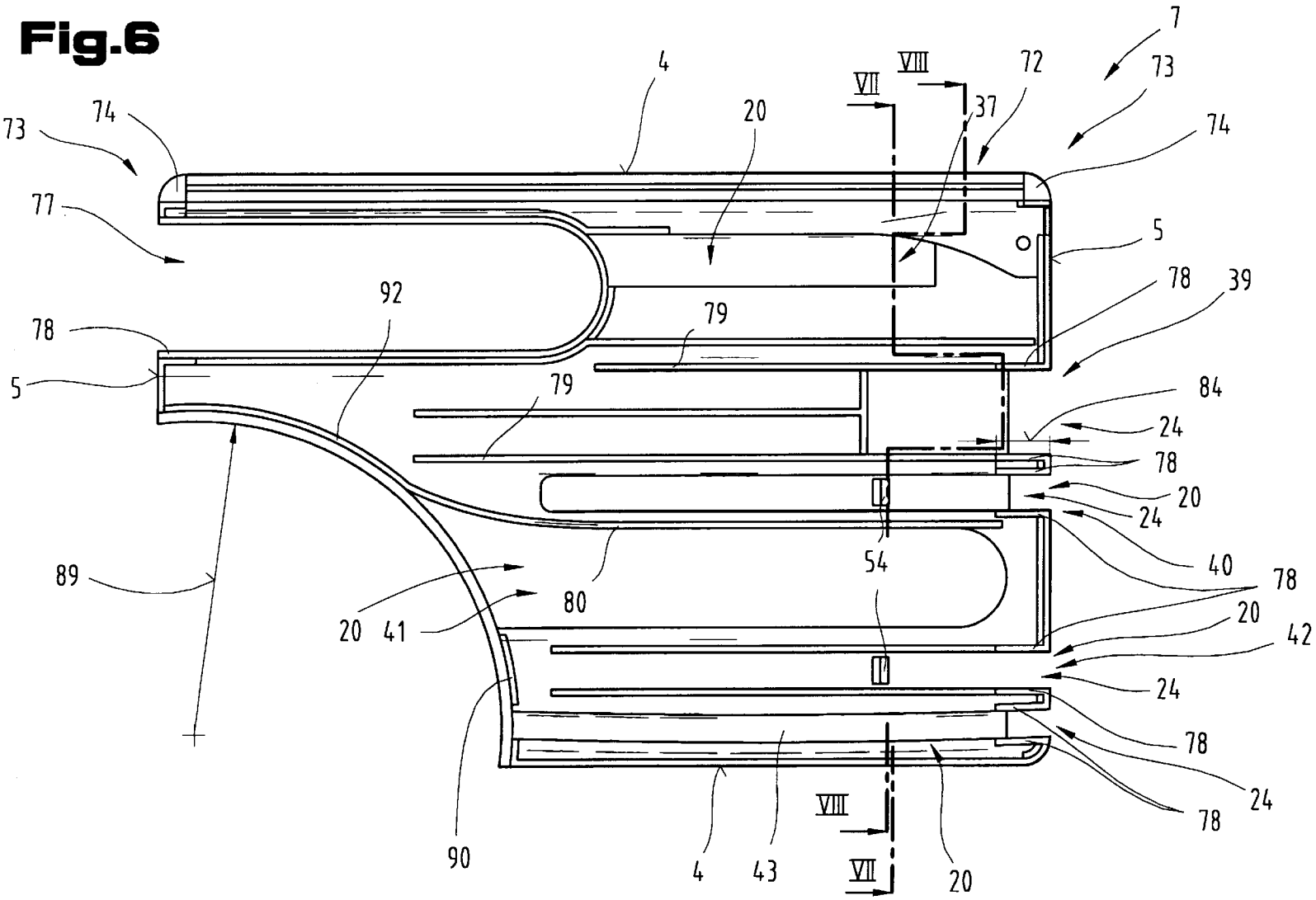
FIG. 6 shows an implement holder as proposed by the invention, in particular the cover plate of the housing body, shown in a plan view.

FIGS. 6 t o 8 illustrate the cover plate 7 in more detail. This is bounded by the longitudinal end faces 4 running parallel with one another and the transverse end faces 5 extending parallel with one another perpendicularly thereto. Extending, along the longitudinal end face 4 is a centring ridge 72 having centring projections 74 in corner regions 73.

Figure 8:
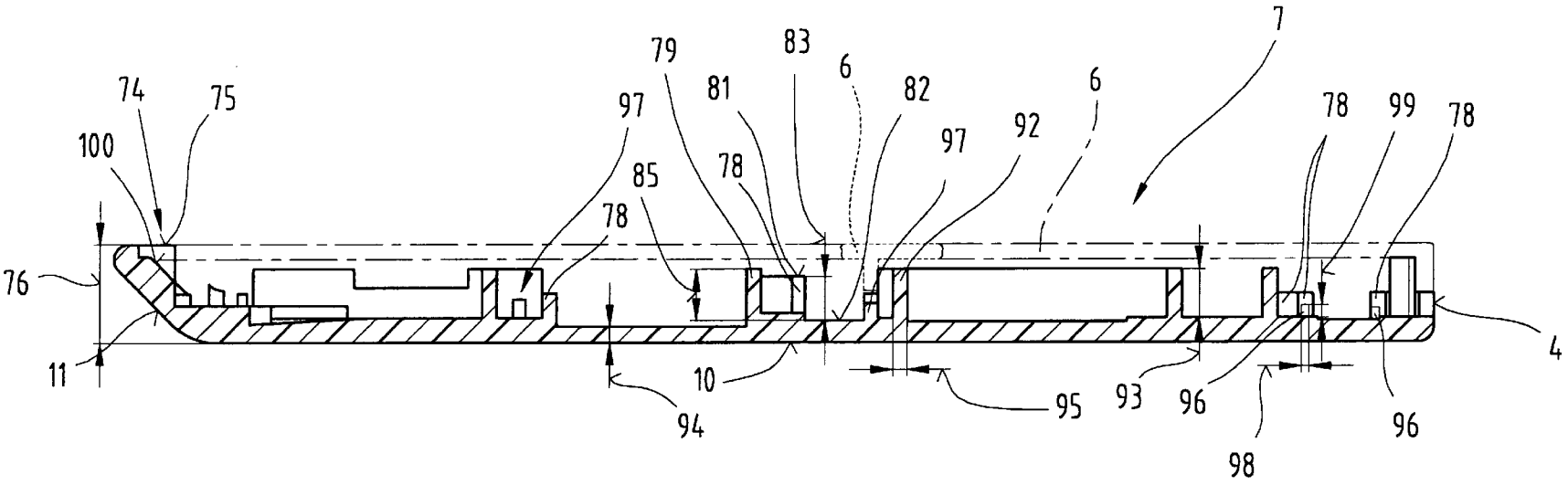
FIG. 8 shows the implement holder, in section along the lines VIII—VIII of FIG. 6.

The longitudinal end face 4 has an inclined face 10 running at an incline relative to the top face 10. Remote from the top face 10 and running parallel therewith is an internal face 75 delimiting the centrings projections 74—as shown in FIG. 8—being spaced apart from the top face 10 by a height 76. This height 76 constitutes the thickness 35 of the housing body 1 illustrated in FIG. 2, since the centring projections 74 engage in the free regions 57 of the bottom plate 6 illustrated in FIG. 3 and close them off with the bottom face 19 forming, an approximately flat surface.

In an opposing layout more or less the same as that of the bottom plate 6, the cover plate 7 has an opening 77 for the recessed depression of the knife blade 16, the opening 77 being used in particular to house the knife handle 17.

The recessed depression for the file 39 is located in the cover plate 7 in the direction opposite the longitudinal end face 4 .

The recessed depression for the tweezers 40 is also enclosed by a ridge-type centring compartment 78. It is also bounded by a longitudinal ridge 79 of the recessed depression for the file 39 and by a longitudinal ridge 80 of the recessed depression for the clippers 41. The ridge-type centring, compartments 78 have—as can be seen from FIG. 8—a top face 81, which is spaced apart from a base face 82 extending parallel with the top face 10 by a height 83. The centring compartments 78 also run as far as a depth 84, adjoining which the longitudinal ridges 79 extend for example, being spaced apart from the base face 82 by a ridge height 85. This being the case, the ridge height 85 is greater than the height 83. Another recessed depression 20 is provided as a recessed depression for the clippers 41 which is also arranged on the cover plate 7.

The recessed depression for the toothpicks 42 arranged on the cover plate 7 forms another recessed depression 20.

The storage case 1 is assembled in the following manner. First of all, the hinged plate 28 is arranged on the bottom plate 6, in which the hinge mounting 31, provided as a bore, is provided. The hinge pin 30 is preferably made up of individual pins which are elastically deformed in a direction facing one another as they are inserted in the hinge mounting 31 and are secured to prevent them from moving axially by means of locating projections, thereby stopping the hinged plate 28 from working loose from the hinge mounting 31. The hinged plate 28 may now be swung across an angular range along a curved ridge 36 to approximately 45° until a swivel stop arranged on the hinged plate 28 comes to bear against a restricting ridge 86 in the region of the hinge mounting 31, illustrated in FIG. 3. If the hinged plate 28 is now swung back so that end faces of the hinged plate 28 more or less coincide with a longitudinal end face 4 and transverse end face 5, a stop ridge of the hinged plate 28 will be located in a moulded region 87, illustrated in FIG. 3, which is arranged in a peripheral ridge 88 extending along the longitudinal end face 4.

Figure 7:
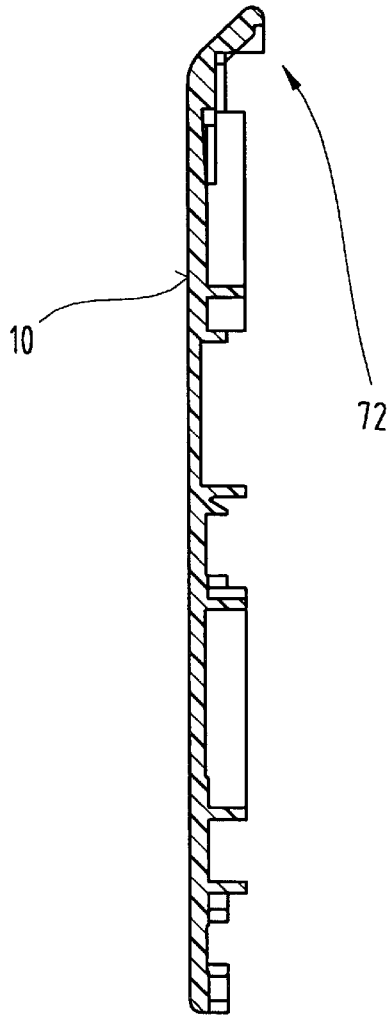
FIG. 7 illustrates the implement holder, in section along the lines VII—VII of FIG. 6.

If the hinged plate 28 is now attached to the bottom plate 6 by inserting the individual pins into the hinge mounting 31, the cover plate 7 can then be placed on the bottom plate 6. In doing this, the centring projections 74, which can be seen particularly clearly in FIG. 7, are inserted in the free regions 57 of the bottom plate 6. In addition, the centring ridges 59 for example, which can be seen in FIG. 3, are brought into a position of alignment with the centring compartments 78. Furthermore, as can be seen more clearly from FIG. 6, a part-ridge 90, also extending in a radius of curvature 89, is brought into a contact joint with a connecting ridge 91, which can be seen in FIG. 3, so that the stop of the part-ridge 90 on the connecting ridge 91 will prevent any parallel sliding between the bottom plate 6 and the cover plate 7. Sliding will also be prevented by means of a guide ridge 92, illustrated in FIG. 6, the guide surface of which is brought into a touch contact with a surface of the curved ridge 36 so that the cover and bottom plates 7, 6 arc attached to one another in a specific position.

The bottom plate and cover plate 6, 7 can be joined to one another by a layer of adhesive or by ultrasonic welding or similar.

The essential factor for all the above embodiments of a flat-design storage case is that an internal height 93, i.e. the free measurement perpendicular to the base and cover plates 6, 7 between the facing interior faces of the base and cover plates 6, 7 is the same as or greater than a thickness of the item to be housed, in particular the implement 9. Accordingly, the ridges 36, e.g. the stop ridge 48, the longitudinal ridges 66 and/or the centring ridges 60, which stand vertically across these interior faces of the base and cover plates 6, 7, extend respectively from the cover plate 7 in the direction of the bottom plate 6 and from the bottom plate 6 in the direction of the cover plate 7 across the entire internal height 93 or respectively across only a part of the internal height 93, so that when the base and cover plates 6, 7 are laid one against the other they extend respectively from the bottom plate 6 to the cover plate 7 or together form an end to end ridge 36 from the bottom plate 6 to the cover plate 7.

The layout of ridges 36 of the type which are arranged on the interior face of the bottom plate or cover plate 6, 7 and project across the entire internal height 93 has an advantage in that extremely thin wall thicknesses 94 can be obtained in the region of the base and cover plates 6, 7 since the requisite stiffening for the base and cover plates 6, 7 can be produced by means of the height of these ridges 36.

If the ridges 36 extend across the entire internal height 93, it is also of advantage to have several ridges 36 arranged lying parallel with one another distributed across the flat-design storage case, thereby producing a ribbing of the component and as a result obtaining wall thicknesses 94 and thicknesses 95 of the ridges 36, so that the plastic can be evenly distributed in all cavities across this flat-design storage case by means of an injection moulding process during manufacture.

Clearly, this design of the thickness 95 applies not only to the guide ridge 92 but also to all the other ridges 36 mentioned in this description by other names.

Furthermore, an advantageous provision can be made if joining ridges 96, 97 are provided on the base and cover plates 6, 7 in the joining regions between the ridges 36 in the region at which they are laid in contact with the oppositely lying plate, i.e. against the moulded ridges 36 on the bottom plate 6 in the region of the interior face of the cover plate 7 or vice versa. These joining ridges 96, 97 are of a considerably narrower width 98 than the thickness 95 of the ridges 36, e.g. the centring ridges 60, the longitudinal ridges 66, the stop ridges 48 and the ridges 36.

A height 99 of the joining ridges 96, 97 will be between 0.01 and 0.5 mm. These joining ridges 96, 97 primarily act as what might be termed energy directors during the ultrasonic welding process in which a connection is made between the respective ridge 36 and the base or cover plate 6, 7 lying opposite it. By arranging these energy directors of the individual ridges 36 spaced apart from one another in a longitudinal direction, it is also possible to produce regions in the housing body 1 which will allow a certain capacity for elastic movement perpendicular to the top face 10 of the cover plate 7. This has the advantage of providing the extra volume needed when inserting objects, in particular implements 9, and positioning the objects in matching retainers or retaining lugs without disturbing the permanent connection in the region of the adhesion points or weld points. It is also of advantage when joining the two parts by means of adhesive to apply the adhesive at the joining ridges 96, 97 illustrated in the drawings by thin broken lines. The distance between the individual joining ridges 96, 97 can then be selected with a view to allowing the requisite elastically resilient deformation of the cover plates.

Clearly, it would also be possible within the scope of the invention, by using ridges 36 running parallel and which, depending on their height at least overlap or extend across the entire internal height 93, to make use of the ridges 36 lying against one another when the cover plate 7 is placed on the bottom plate 6 as guide members for centring the two parts.

Additional centring aids may also be provided for this purpose, such as for example inclined surfaces 100 extending at an incline relative to the top face 10 of the cover plate 7, by means of which the cover plate 7 can be centred and positioned on the bottom plate 6 allowing for the tolerances required for manufacturing purposes.

Clearly, it would also be possible to provide parts of the surfaces of the housing body 1 and the hinged plate 28, in particular the top face 10 of the cover plate 7 with an appropriate galvanic coating or a coating applied or bonded in another manner, which might be reflective, for example, so that it can be used as a mirror. Clearly, however, it would also be possible to provide the top face 10 or the opposing bottom face 19 of the bottom plate 6 at least partially with solar cells in order to be able to operate a power storage device provided in the plate for other applications, e.g. a VHF receiver, emergency transmitter devices for indicating position, signal lamps or lighting devices or to be able to charge a power battery.

The distribution and layout of the individual objects inside the interior of the flat-design storage case 1 can be modified as required.

Within the context of the invention, individual parts of the individual embodiments can be put together in any combination with one another, which means that not only can individual parts or groups of parts provide independent objects of the invention in their own right but also individual parts, in particular the layout of the housing compartments 8 of the individual embodiments, can be moved around as required as can the arrangement of the ridges 36 and joining ridges 96, 97. Particularly advantageous above all is the embodiment in which the recesses are arranged in the bottom plate 6 on the one hand and in the cover plate 7 on the other and only a base and a cover plate 6, 7 are provided which are retained at a distance apart from one another depending on how the ridges 36 are arranged in terms of their height and the ridges 36 projecting across the entire internal height 93.

FIGS. 9 to 13 will be described together and illustrate an embodiment of the implement holder proposed by the invention, in particular an embodiment of the flat-design storage case provided in the form of the housing body 1 . It has a housing compartment 8 for a multi-purpose tool 101. This is bounded by the bottom plate 6 and the cover plate 7 and by ridges 36 projecting from the bottom plate 6 in the direction of the cover plate 7 and/or matching these from the cover plate 7 in the direction of the bottom plate 6, side ridges 102 being arranged perpendicular to the transverse end face 5 and a cross ridge 103 parallel with the transverse end face 5. The side ridges 102 are spaced at a distance 104 from one another measured parallel with the transverse end face 5, a wider section 105 being arranged between the transverse end face 5 and the side ridges 102.

This is used to receive tools 107 projecting out from a main body 106 of the multi-purpose tool 101, for example screwdrivers 108. Whereas the screwdrivers 108 and the extreme outer regions thereof located adjacent to the transverse end face 5 are arranged at a distance 109, the tools 107 which are arranged adjacent to the cross ridge 103, which are also screwdrivers 108 in this example, are spaced apart from one another by a distance 110, which, in contrast to the distance 109, is smaller than the distance 104. The tools 107 are arranged in a more or less star design on the main body 106, for example. The main body 106 or the multi-purpose tool 101 is of a thickness 111 measured perpendicular to the base of the depression 53 that is smaller than the internal height 93, which is bounded by the depression base 53 and an oppositely arranged internal face 112 extending parallel therewith. The internal face 112 and/or the depression base 53 are surmounted by inner ridges 113 in a direction facing one another, top faces 114 of the inner ridges 113 facing one another being spaced at a height 115 apart from one another, which approximately corresponds to the thickness 111 of the multi-purpose tool 101 provided as an implement 9. The multi-purpose tool 101, in particular the main body 106, has a moulded piece 116 arranged in the region of a recess 117 provided in the cover plate for example, so that the multi-purpose tool 101 can be readily removed from the housing compartment 8. The height 115 may be slightly smaller than the thickness 111 of the multi-purpose tool 101 so that the latter is retained in the housing compartment 8 by means of a friction fit.

The main body 106 of the multi-purpose tool 101 has a bore 118 with a diameter 119. Extending in the region of the bore 118 from the internal face 112 projecting beyond it for example in the direction of the depression base 53 are ridges 36, which are designed as retaining ridges 120. An internal face 121 of the retaining ridges 120 facing the depression base 53 is spaced apart from the internal face 112 of the cover plate 7 by a distance 122 which is greater than a distance 123 between the internal face 112 and a top face 124 of the main body 106 facing it. The retaining ridges 120 therefore engage in the bore 118, which prevents the multi-purpose tool 101 from slipping out from the housing compartment 8 of its own accord. In the region of the bore 118, the depression base 53 has an inner ridge 113, the top face 114 of which is spaced apart from the internal face 121 of the retaining ridges 120 by a distance 125 which is preferably smaller than the thickness 111.

In an end region of the multi-purpose tool 101 opposite the compartment opening 23 for the multi-purpose tool 101, limiting ridges 126 are provided on the cover plate 7 and on the bottom plate 6, which delimit the housing compartment 8 for the multi-purpose tool 101. The internal faces 121 of the retaining ridges 120 are of a curved design so that when the multi-purpose tool 101 is removed form the housing compartment 8, the top face 124 of the main body 106 and an end edge 127 of the bore 118 in the region of the top face 124 slide along the internal face.

In addition, the housing body 1 has a housing compartment 8 for a writing instrument 128, in particular a ball-point pen 129, which is formed by depressions for the ball-point pen 43 in the bottom plate 6 and/or the cover plate 7. The implement 9, in this case a ball-point pen 129, is therefore retained in the housing compartment 8 by means of a positioning and/or locating device 130. As can be seen more clearly from FIGS. 10 to 12, this consists of an operating element 131, which is guided along the longitudinal ridges 132 of the housing compartment 8 for the writing instrument 128. The operating element 131 has, centrally to a central axis 133 of the writing instrument 128, a compartment 134 with a retaining jaw 135, in which a locating projection 136 of the writing instrument 128 is retained. In addition to the retaining jaw 135, which has a more or less C-shaped cross-section and is elastically deformable in a radial direction, the compartment 134 has a bore 137 with a diameter 138 and a housing compartment 139 with a compartment diameter 140 which is larger than a diameter 141 of the retaining jaw 135 and corresponds more or less to an external diameter 142 of the locating projection 136.

In the region of an end face 143 of the operating element 131 running approximately perpendicular to the longitudinal ridges 132, the compartment 134 has a centring means 144, having in the region of the end face 143 a diameter 145 which is greater than the external diameter 140 of the locating projection 136. As a result, it is possible to move the writing instrument 128, in particular the locating projection 136, into the centring device 144, which causes the bore 137 and accordingly, as the writing instrument 128 is inserted, the retaining jaw 135 to be elastically widened so that the locating projection 136 can be inserted into the region of the housing compartment 139 and, when this position is reached, the bore 137 will revert to the bore diameter 138 thereby preventing the writing instrument 128 from working loose from the operating element 131 of its own accord. When the ball-point refill has run out, it can therefore be pulled out from the retaining jaw 135 against the deformation resistance and replaced with a new one.

As a result, the writing instrument 128 can easily be replaced, in particular if it runs out. The operating element 131 has a gripping element 146 in a region remote from the depression base 53 which projects through a slit 147 preferably arranged in the cover plate 7 or a side wall between the cover plate 7 and the bottom plate 6. On a face remote from the depression base 53, the gripping element 146 preferably has rib-type recesses 148, which make handling of the operating element 131 and hence the writing instrument 128 easier.

Figures 15, 16, 17:
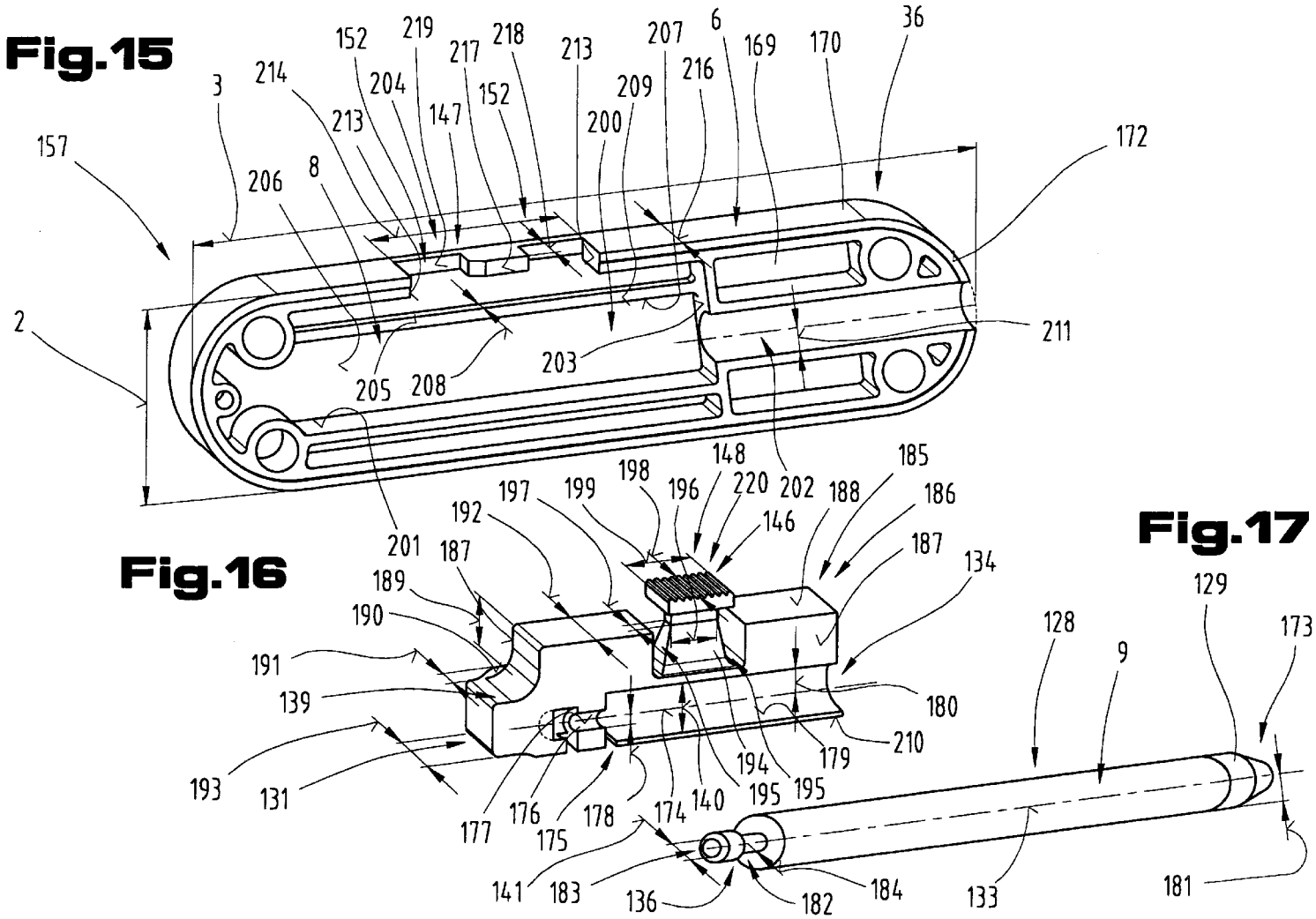
FIG. 15 shows the implement holder, in particular a bottom plate, in a perspective view.
FIG. 16 shows the implement holder, in particular an operating element, seen in a perspective view.
FIG. 17 shows the implement holder, the implement provided specifically being a writing instrument, seen in a perspective view.
Figure 18:
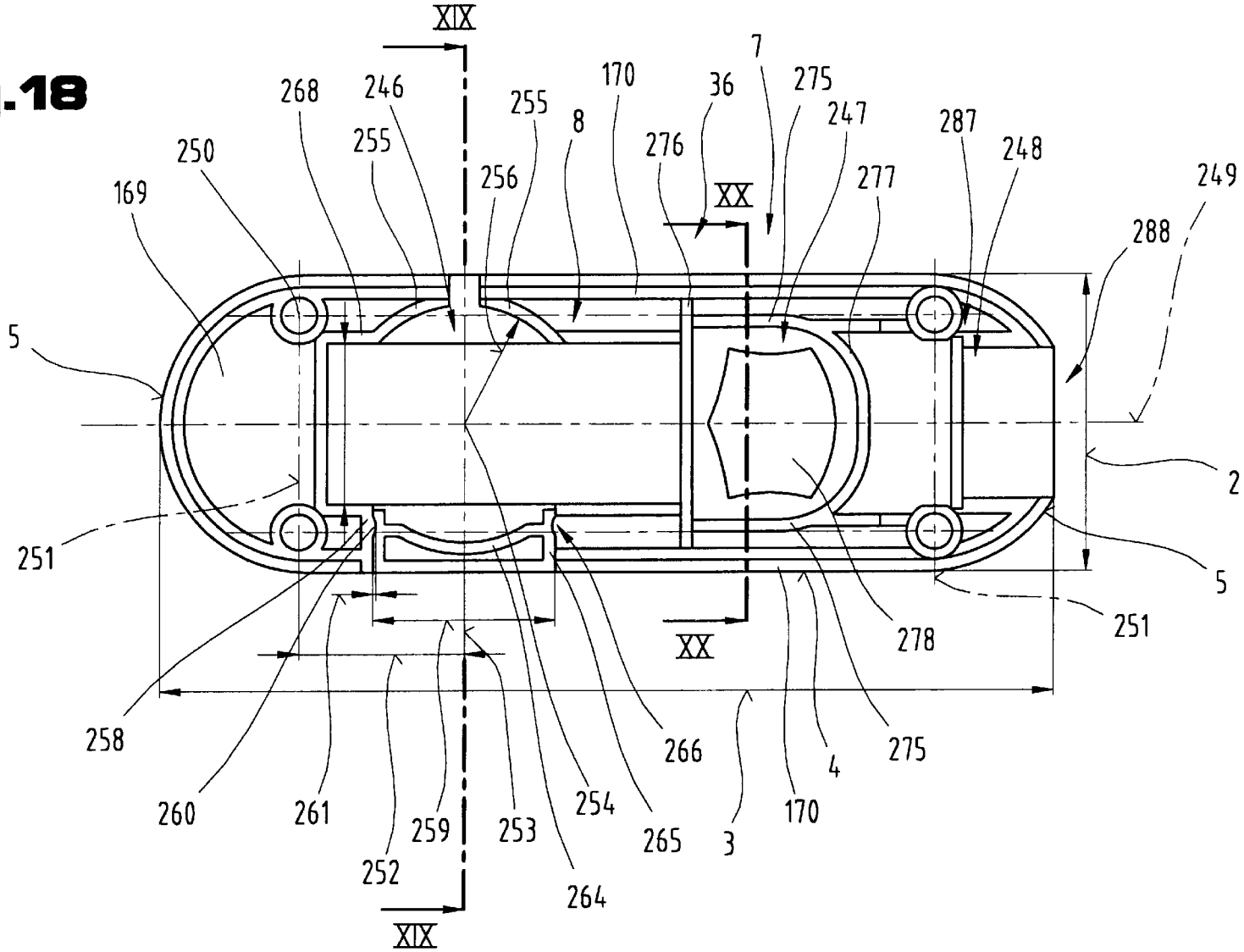
FIG. 18 shows the implement holder, in particular a cover plate, seen in a plan view.
Figure 20:
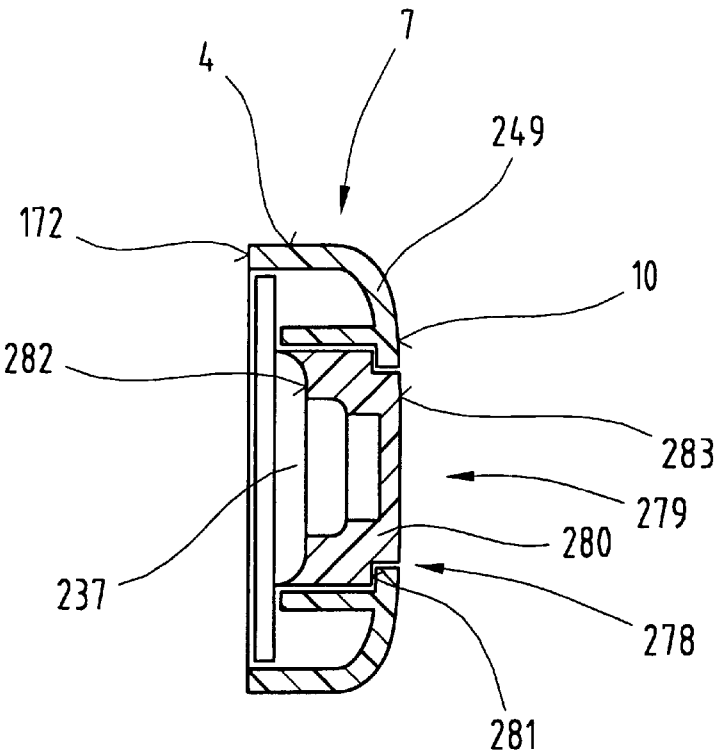
FIG. 20 shows the implement holder in section along the lines XX—XX of FIG. 18.
Figure 19:
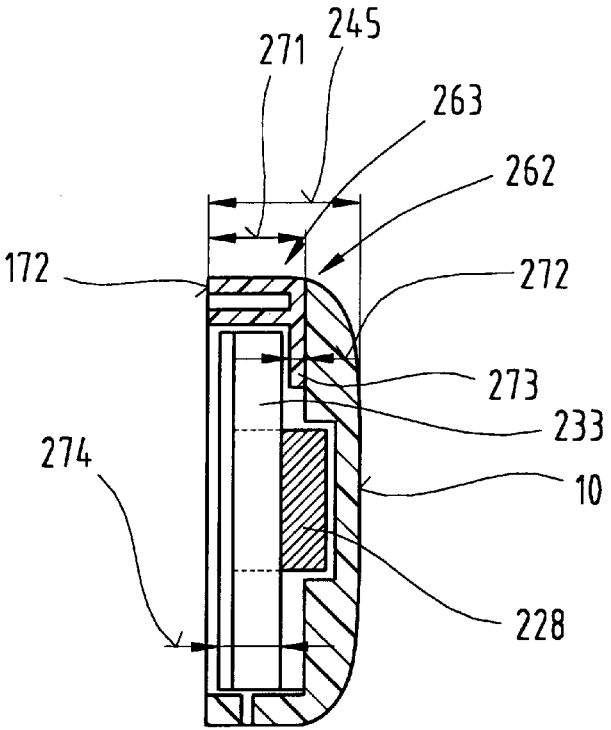
FIG. 19 shows the implement holder in section along the lines XIX—XIX of FIG. 18.

In the direction of the central axis 133 of the writing instrument 128, the operating element 131 has guide elements 149 arranged one after the other at a distance, which are provided between the longitudinal ridges 132 in a transverse direction, preferably with a slight lateral clearance and which also look like a similar component illustrated in FIG. 16. Arranged between the two guide elements 149 and approximately perpendicular to the longitudinal ridges 132 is an elastically adjustable locating lever 150, which is inclined across an angled ridge 151 relative to the central axis 133 so that the gripping element 146 is arranged laterally offset from the central axis 133 when the ridge 151 is not being deformed.

Figure 11:
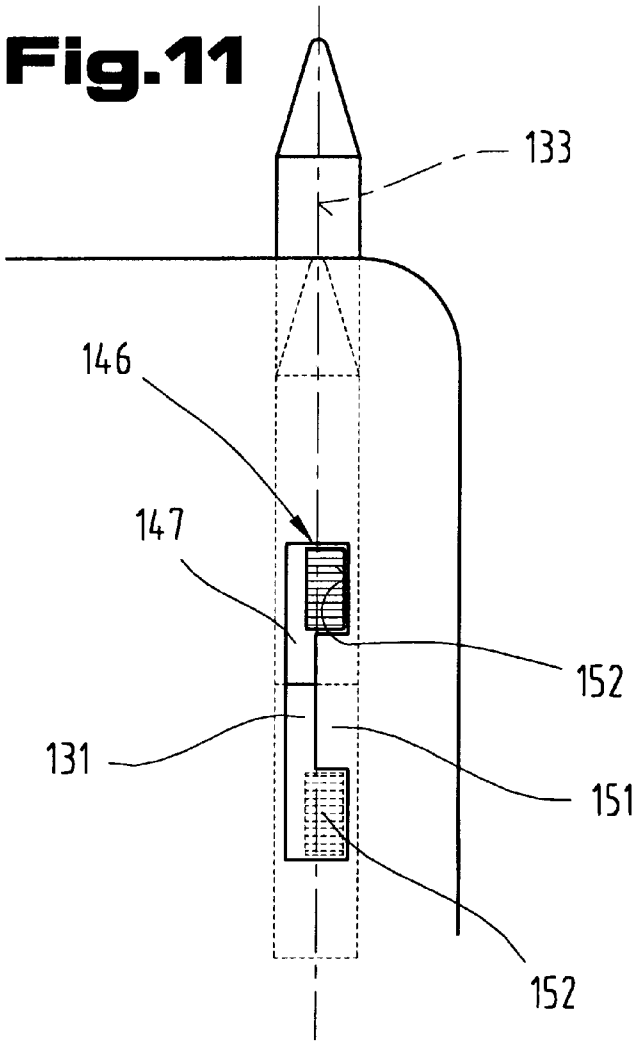
FIG. 11 is a part area of the implement holder seen in plan view.
Figure 13:
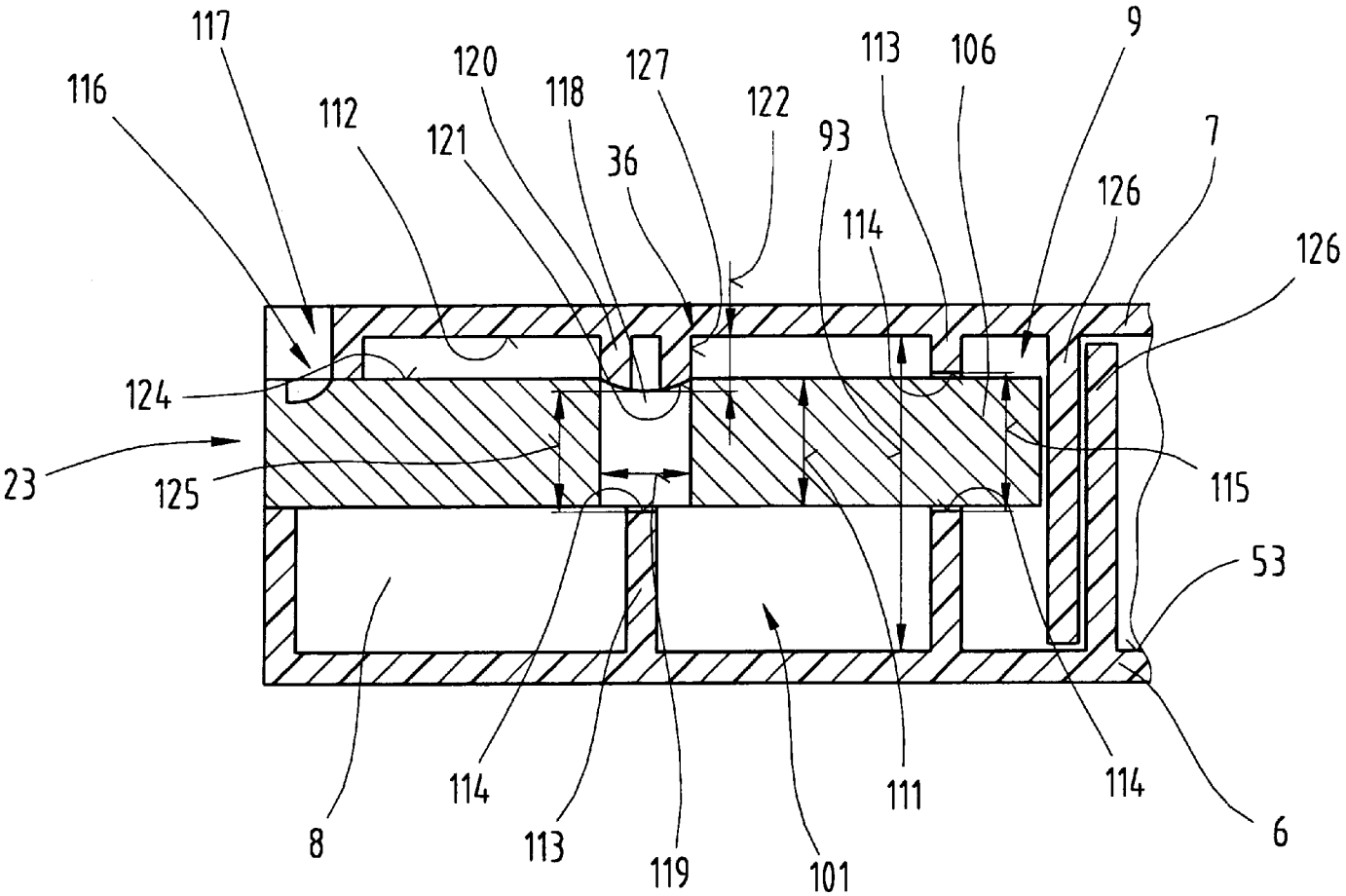
FIG. 13 shows the implement holder in section along the lines XIII—XIII of FIG. 9.
Figure 14:
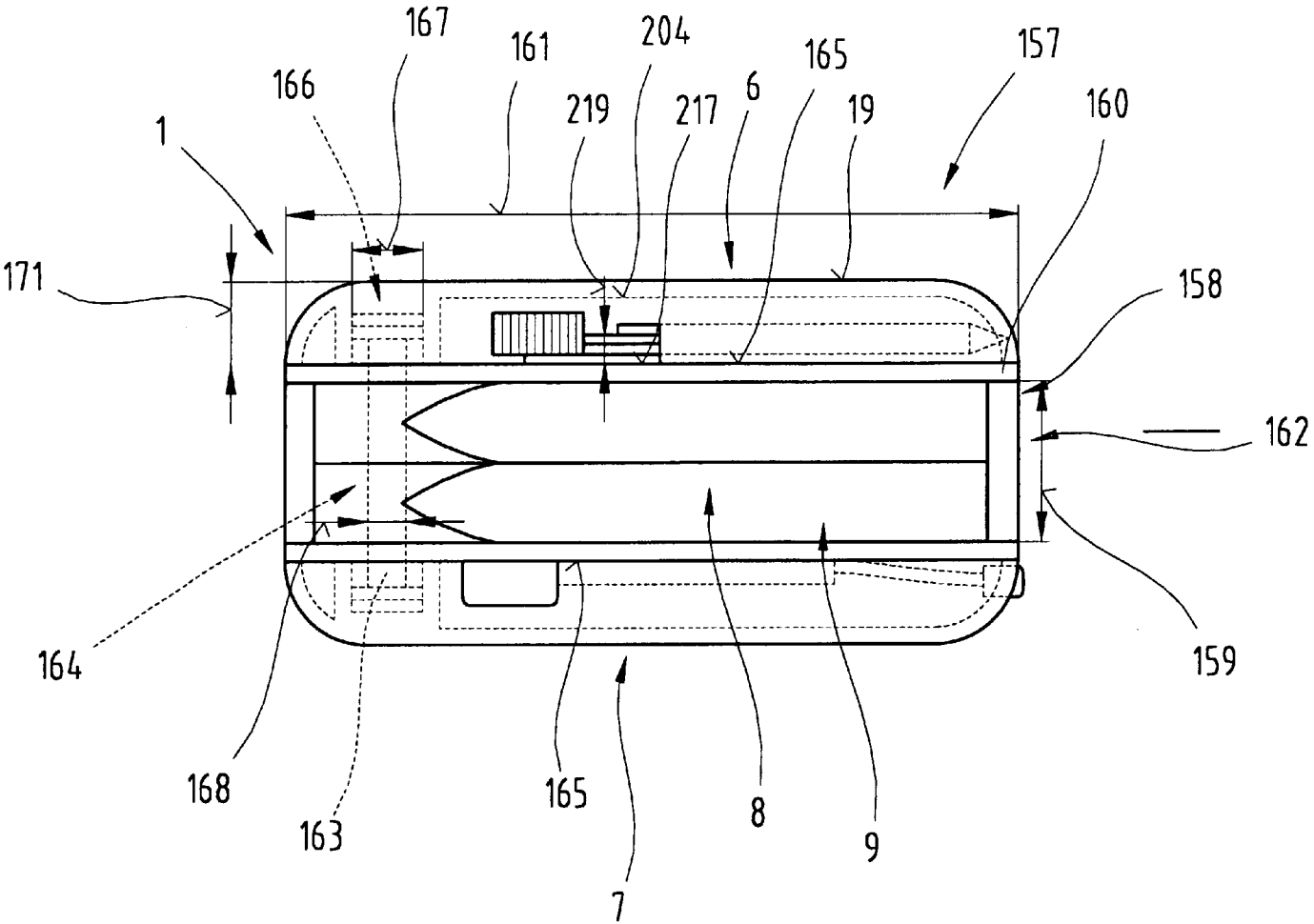
FIG. 14 is another embodiment of an implement holder proposed by the invention, in particular a housing body designed as a pocket knife, seen in a plan view.

As may be seen from FIG. 11, the slit 147, in which the ridge 151 and the gripping element 146 are able to slide in the direction of the central axis 133 is provided with locating recesses 152 in the end regions thereof which project laterally beyond the slit 147 in the end region of the slit 147 in a same direction.

If the gripping element 146 is in the region of one of the locating recesses 152, the ridge 151 is not deformed or is only slightly deformed. The locating action occurs due to the fact that either the gripping element 146 or the ridge 151 is of a length which more or less matches the length of the locating recesses 152 so that the waiting instrument 128 is prevented from sliding in the direction of the central axis 133 in this position.

If the writing instrument 128 is displaced, the gripping element 142 will be deformed against the rebound effect of the inclined ridge 151 in the direction of the slit 147 and can be moved from one locating recess 152 in the direction of the other locating recess 152 and, because of the return force inherent in the deformation, the gripping element 146 and the ridge automatically engage in the locating recess 152 so that the writing instrument 128 is retained and held either in the stowed rest position or in the retracted writing position.

In the retracted ready-to-use position projecting out from the external periphery of the storage case, in particular the housing body 1, the flat-design storage case, in particular the housing body 1, will then form a gripping piece 153 of the implement 9, in particular the writing instrument 128.

Figure 9:
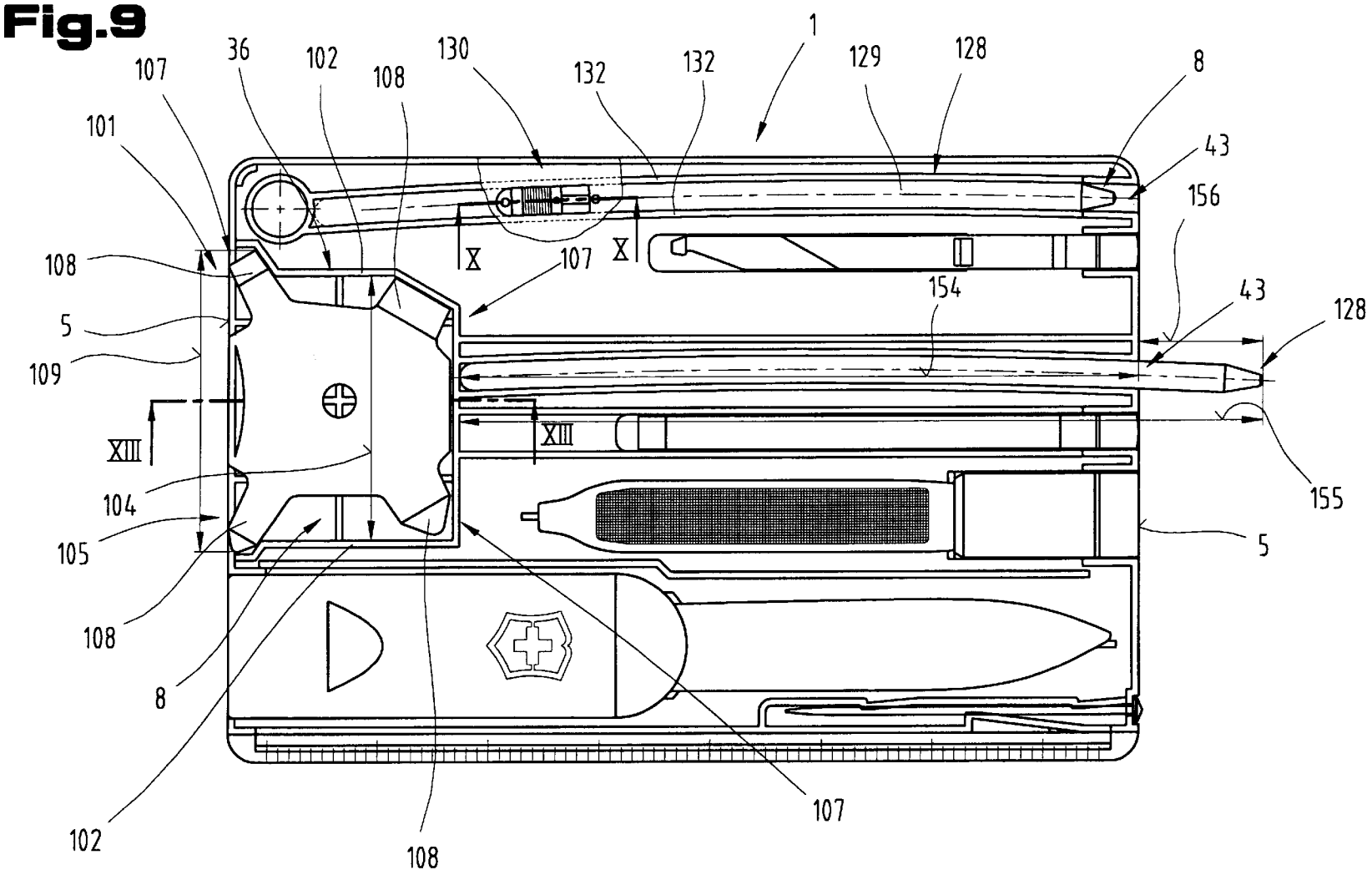
FIG. 9 is another embodiment of the implement holder proposed by the invention, specifically a housing body with a holder case of a flat design, shown in a plan view.
Figure 10:
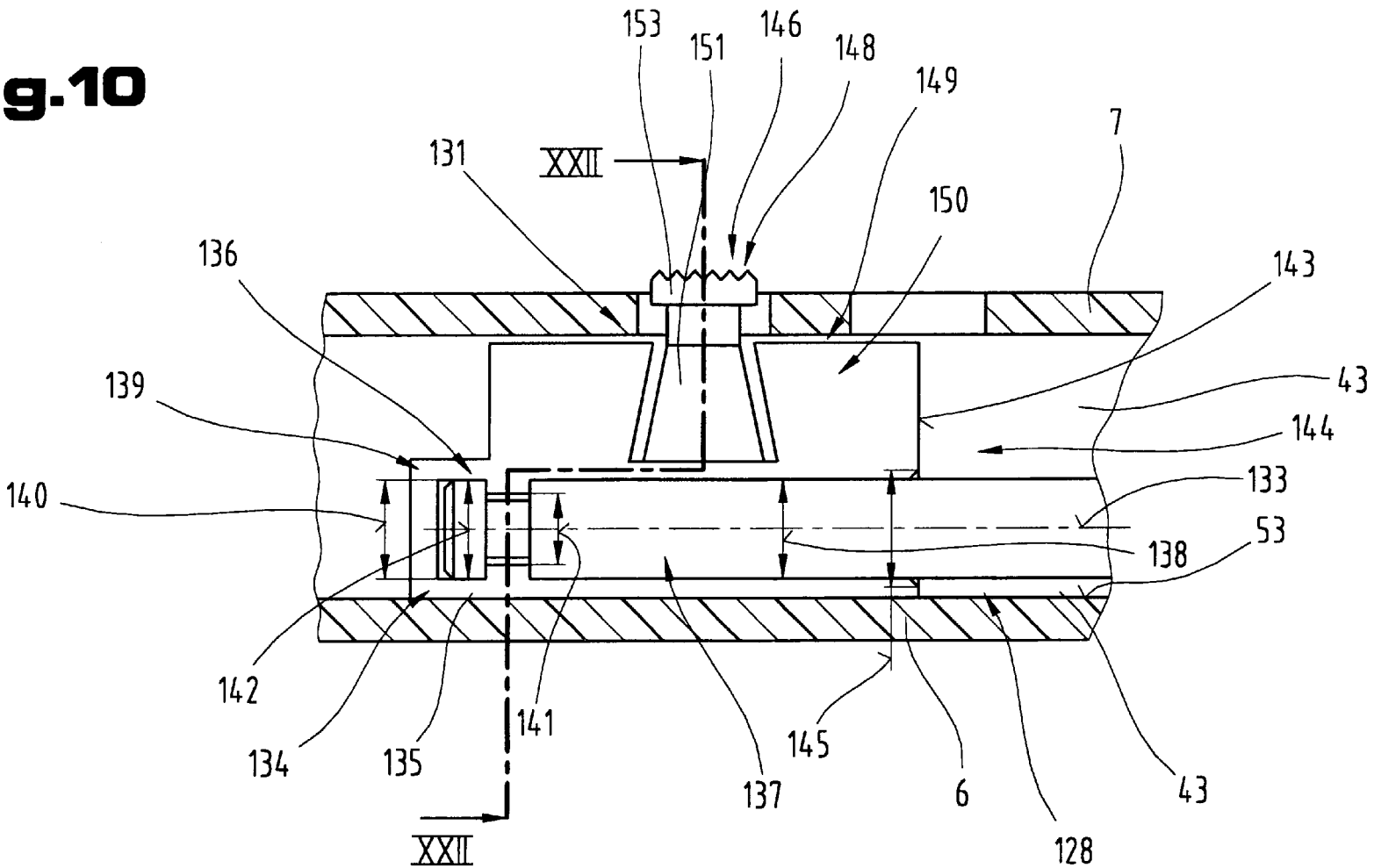
FIG. 10 shows the implement holder in section along the lines X—X of FIG. 9.
Figure 12:
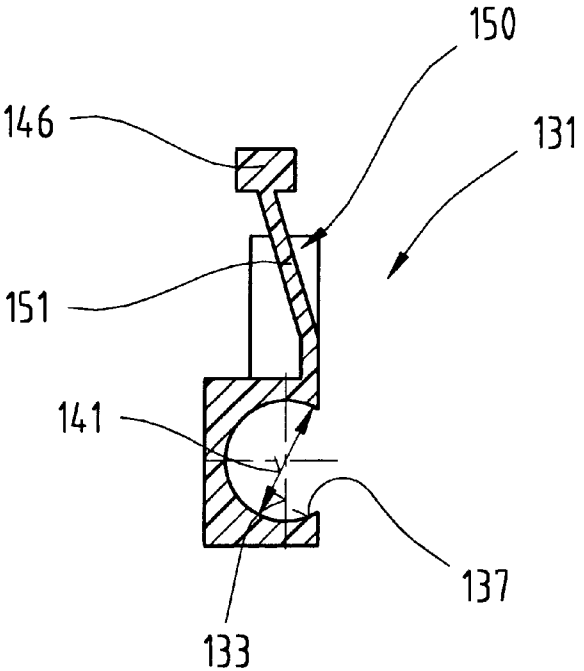
FIG. 12 is a part area of the implement holder, in particular an operating element, in section along the lines XII—XII of FIG. 10.

The housing body 1 illustrated in FIG. 9 may have another ball-point pen depression 43 in which a writing instrument 128 is arranged. This writing instrument 128 may be provided in addition to the writing instrument 128 which is adjusted by means of the positioning and/or locating device 130. However, it may be that the housing body 1 does not have a writing instrument 128 adjusted by the positioning and/or locating device 130 and has only the non-adjustable writing instrument 128. This ball-point pen depression 43 illustrated in FIG. 9 as another embodiment has a recess 154 running from the transverse end face 5 in the direction of the transverse end face 5 remote therefrom which is smaller than a length 155 of the writing instrument 128. Consequently, in the ready-to-use position, the writing instrument 128 projects beyond an external periphery formed by the transverse end face 5 by a length 156. In the ready-to-use position, the writing instrument 128 can be removed from the ball-point pen depression 43 so that it can be returned to a rest position in which the writing instrument 128 can be inserted in the ball-point pen depression illustrated in FIG. 3, from which it will not project beyond the external periphery, i.e. beyond the transverse end face 5, for example.

FIGS. 14 to 22, which will be described together, illustrate another embodiment of the implement holder proposed by the invention, in particular a pocket knife 157, which has a housing body 1. This consists of an intermediate element 158 having two flat-shaped elements 160 spaced at a distance 159 apart from one another and of a length 161 measured perpendicular to the distance 159. The length 161 and the distance 159 form an intermediate space 162 which serves as a housing compartment 8, in which several implements 9 are arranged. The flat-shaped elements 160 are joined to one another by means of connecting elements 163, which are of a bolt design and preferably form one or more pivot-bearings 164 for the implements 9 so that the implements 9 can be pivoted about the bolt-design connecting elements 163 out from the intermediate space 162 or housing compartment 8, where they are laid in the rest position, into a position ready for use in which the implements 9 project beyond the housing body 1 or external periphery thereof. This being the case, the connecting elements 163 project beyond external sides 165 of the flat-shaped elements 140 facing one another in a direction opposite the intermediate space 162. In this region projecting beyond the external sides 165, the connecting elements 163 therefore have a collar 166 with a collar diameter 167 which is bigger than a diameter 168 of the connecting element 163. Located on the external sides 164 are a bottom plate 6 and a cover plate 7 of the housing body 1.

A perspective view of the bottom plate 6 is illustrated in more detail in FIG. 15, for example. The bottom plate 6 consists of a base plate 169 of a length 3 and a width 2 measured perpendicular thereto. The length 3 matches the length 161 of the intermediate element 158 illustrated in FIG. 14. The base plate 169 is preferably surrounded by a peripheral ridge 36, designed as an external ridge 170, producing a bottom plate height 171 measured perpendicular to the length 3 and 161. This is delimited by a bottom face 19 delimiting the bottom plate 6 in the direction opposite the intermediate element 158 and a joining face 172 parallel therewith and remote therefrom extending in the direction towards the intermediate element 158 delimiting the external ridge 170.

The bottom plate 6 has a housing compartment 8 for an implement 9, for example a writing instrument 128, which in this case is a ball-point pen 129. The ball-point pen 129 has a writing tip 173 at an end region and, at an end region remote therefrom, a locating projection 136, such as conventionally provided for writing refills. The writing instrument 128 is inserted in a compartment 134 arranged in an operating element 131. The compartment 134 has an approximately semi-circular cross-section having a compartment axis 174, which coincides with a central axis 133 of the writing instrument 128 immediately the latter is placed in the compartment 134. In an end region of the compartment 134, the operating element 131 has a retaining device 175, which is formed by means of a resiliently elastic clamp ridge 176 having a clamping surface 177 facing the compartment axis 174 and spaced apart from the compartment axis 174 by a distance 78 which is smaller than a distance 180 measured from the compartment axis 174 to a compartment face 179 of the compartment 134. This more or less corresponds to a radius 181 of the writing instrument 128, which is preferably cylindrical in design 128.

The locating projection 136 has a connecting piece 182 extending about the central axis 3 which is preferably cylindrical and retains a locating barrel 183. The connecting piece 182 has a radius 184 which approximately matches the distance 178. The locating barrel 183 is of an external diameter 142 which preferably corresponds to the compartment diameter 140 made up of the double distance 180.

When the writing instrument 128 is inserted in the compartment 134, the locating projection 136 first, and the locating barrel 183 reaches the region of the clamp ridge 176, the clamp ridge 176 is elastically deformed so that the distance 178 from the clamp surface 177 to the compartment axis 174 reaches a half measurement of the external diameter 142. If the writing instrument 128, in particular the locating barrel 183, is moved further, it reaches the region of a housing compartment 139 of the compartment 134, the diameter of which is that of the compartment diameter 140 so that the clamp ridge 176 is brought to a position virtually coinciding with the connecting piece 182 and will therefore spring back in the direction towards the compartment axis 174. Consequently, the writing instrument 128 will be prevented from working loose from the operating element 131 of its own accord.

The operating element 131 has a guide part 185, in which the compartment 134 is located. The guide part 185 has a guide ridge 186 bounded by two lateral guide surfaces 187 parallel with and facing one another. One lateral guide surface 187 remote from the compartment 134 runs from a top face 188 extending perpendicularly thereto across a height 189 to a height guide face 190 extending parallel with the top face 188 which is of a width 191 measured perpendicular to the lateral guide surface 187. The lateral guide surfaces 187 are spaced apart from one another by a guide ridge width 192 so that the operating element 131 is of a total width 193 made up of the sum of the guide ridge width 192 and the width 191 of the height guide surface 190.

The top face 188 of the guide part 185 has a gripping element 146 projecting beyond it in the direction opposite to the compartment 134. This has a preferably elastically resilient ridge 194 which is joined to the guide part 185. The ridge 194 is spaced back from the guide part 185 by free regions 195 and, in the region of the gripping element 146, has a ridge width 196 measured perpendicular to the total width 193 and a ridge thickness 197 measured perpendicular thereto. The gripping element 146 in turn is of a width 198, measured parallel with the ridge thickness, which is greater than the ridge thickness 197 and a length 199, measured perpendicular thereto, which is greater than the ridge width 196. In addition, the ridge 194 runs at an incline in the direction towards the height guide face 190.

The housing compartment 8 arranged in the bottom plate 6 forms a guide device 200 for the writing instrument and the operating element 131. Accordingly, the guide device 200 has a height guide surface 201 running perpendicular to the joining face 172 which delimits a stop face 203 in the direction of a guide section 202 for the writing instrument 1 28 extending perpendicular thereto. Running from the height guide surface 201 in the direction of a recess 204 arranged in the external ridge and preferably provided as a slit 147, is a guide ledge 205, which projects beyond an internal side face 206 of the guide device 200 extending perpendicular to the height guide surface 201 and to the stop face 203 in a direction towards the joining face 172. The guide ledge 205 has a bottom face 207 running parallel with and facing the height guide surface and a side face 209 perpendicular thereto and spaced apart from the internal side face 206 by a ledge width 208 in a direction towards the joining face 172. The operating element 131 is inserted with the guide part 185 in the guide device 200 in such a way that the height guide surface 198 co-operates with the bottom face 207 of the guide ledge 205, the side face 209 with the lateral guide face 187 of the guide part 185 and a bottom face 210 of the guide part 185 with the height guide surface 201.

The guide section 202 also has an approximately semi-circular cross-section and a radius 211 corresponding to the distance 180 and matches the radius 181 of the writing instrument 128. The recess 204, designed as a slit 147, is bounded by end faces 212, in particular transverse end faces 213, running perpendicular to the joining face 172. These are spaced apart by a length 214. The transverse end faces 213 therefore form an end stop for the operating element 131. In the region of the transverse end faces 213, the recess 204 has locating recesses 152. The locating recesses 152 have end faces 215 extending parallel with the joining face 172 and spaced apart therefrom by a width 216. Extending between the locating recesses 152 is a longitudinal end face 217 which is spaced apart from the end face 215 in a direction towards the joining face 172 by a distance 218.

The external face 165 of the intermediate element 158 facing the joining face 172 also forms a longitudinal end face 217 in the region of the recess 204. The difference between the width 216 and the distance 218 gives a width 219 of the space between the longitudinal end faces 217 facing one another. The width 219 approximately matches the ridge thickness 197 so that the ridge 194 is not deformed whilst in the region of the locating recesses 152 but is elastically deformed when it is in the region between the longitudinal end faces 217. On reaching the locating recess 152, it springs back into its original position and the operating element 131 is automatically prevented from sliding. The gripping element 146 has a high degree of surface roughness on a top face 200 and in particular has recesses 148.

Clearly, it would also be possible for the writing instrument 128 to be arranged so that it would not be linearly slidable in the housing body 1 but instead could be pivotably mounted in the housing body 1 so that it could be pivoted about a connecting element 163, i.e. about a pivot bearing 164 formed thereby.

Figure 21:
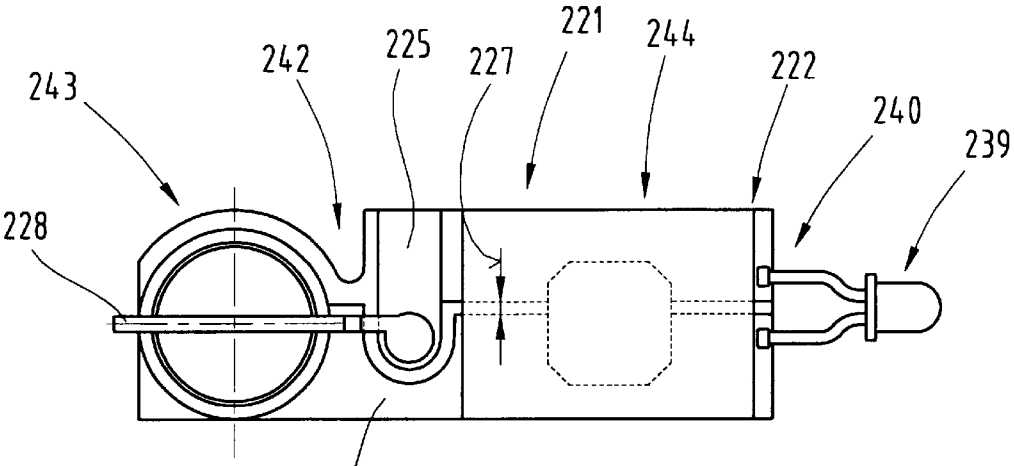
FIG. 21 shows the implement holder, in particular a lighting device, seen from a front view.
Figure 22:
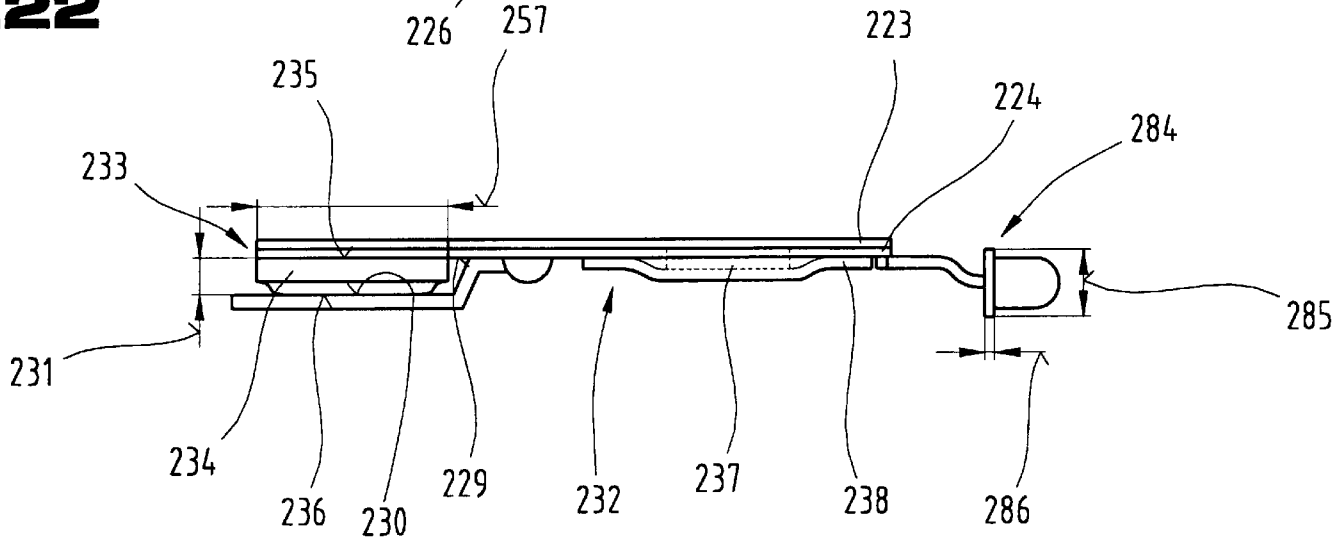
FIG. 22 shows the implement holder, in particular the lighting device, seen in a plan view.

For practical purposes, a lighting device 221 is also arranged in the housing body 1, for example in the cover plate 7, as illustrated in detail in FIGS. 21 and 22. This has a base element 222 of a flat design and a bottom plate 223 made from a non-conductive material with a conductor plate 224 mounted thereon. The conductor plate 224 is made in two parts and consists of two contact plates 225 and 226, which are spaced apart by a distance 227 so that they do not produce a conducting connection. The contact plate 225 has a contact pin 228, which projects above a contact surface 229 remote from the bottom plate 223 in the direction opposite the bottom plate 223. Accordingly, an internal face 239 of the contact pin 228 facing the contact surface 229 is spaced apart from the contact surface 229 by a distance 231.

Another power supply and/or switching device 232 is arranged on the base element 222. This has a power source 233, in particular a battery 234, which is arranged in the region of the distance 23 1 and has a pole surface 235 lying against the contact surface 229 and a pole surface 236 lying against the internal face 230 of the contact pin 228. The power supply and/or switching device 232 has another switching element 237 which is protected from the effects of the weather by means of a cover 238. In an end region remote from the contact pin 228, the base element 222 has a light source 239 which is in contact with the contact plate 225 and/or 226 by means of conductor pins 240. Both the light source 239 and the power supply and/or switching device 232, i.e. the power source 233 and the switching element 237, as well as the cover are therefore arranged in a plane 421 in which the contact face 229 is located. The bottom plate 223 has another moulded section 242 arranged between a housing region 243 for the power source 233 and a housing region 244 for the switching element 237.

As mentioned above, the lighting device 221 is arranged in the cover plate 7 for example. The cover plate 7 has a base plate 169 with a length 3 and a width 2 measured perpendicular thereto. The base plate 169 is surrounded by a ridge 36, preferably designed as a peripheral external ridge 170. This produces a cover plate height 245 measured perpendicular to the length 3 which borders on a top face 10 delimiting the cover plate 9 in a direction opposite the intermediate element 158 and a joining face 172 extending parallel therewith and remote therefrom bordering on the external ridge 170 in the direction towards the intermediate element.

The cover plate 7 has at least one housing compartment 8 which is used to house the lighting device 221. The housing compartment 8 is therefore formed by a part chamber 246 for the power source 233, a part chamber 247 for the switching element 237 and a part chamber 248 for the light source 239. The cover plate 7 also has a central axis 249 bisecting the width 2. Arranged symmetrically about the central axis 249 are connection recesses 250 of a circular cross-section which are used to receive the joining elements 163 illustrated in FIG. 14, in particular the collars 166 thereof. Every two connection recesses 250 have a common central axis 251 for example, which runs perpendicular to the central axis 249.

Located at a distance 252 from a central axis 251 in the direction of the other central axis 251 is a central axis 253 extending perpendicular to the central axis 249. This forms a centre point 254 in conjunction with the central axis 249. Two arcuate limiting ridges 255 run concentrically about this central point 254 from the external ridge 170 in a direction towards the central axis 249 but only in a half region of the cover plate 7 from the central axis 249 and an external ridge 170. The limiting ridges 255 therefore have a radius 256 measured from the central point 254 which, as illustrated in FIG. 22, corresponds to approximately half the battery diameter 257. In the other half region of the cover plate 7 bounded by the central axis 249 and the other external ridge 170, two inner ridges 258 run symmetrically about the central axis 253 from the external ridge 170 in a direction towards the central axis 249, being spaced apart from one another by a distance 259 measured symmetrically to the central axis 253 running parallel with the external ridge 170. The inner ridges 258 have projections 260 on oppositely facing surfaces, which reduce the distance 259 by twice the height 261. The external ridge 170 has an orifice 262. Located in this orifice 262 and in the region between the two inner ridges 258 is a closure element 263, which also has an annular ridge 264 running approximately around the radius 256 and at the centre point 254.

The annular ridge 264 is bordered by side ridges 265 running parallel with the inner ridges 258 each of which has a moulded section 266 in each of which a projection 260 engages, thereby preventing the closure element 263 from coming loose from the orifice 262 of its own accord. Side ridges 268 run from a limiting ridge 255 and from an inner ridge 258 arranged opposite it symmetrically about the central axis 249 spaced apart by a width 267 and are bordered by a cross ridge 269 running perpendicular to the central axis 249. The two side ridges 268 and the cross ridge 269 form a part chamber 270 for the contact pin 228 illustrated in FIG. 21.

The two limiting ridges 255 and the annular ridge 264 form, at least over a partial region, the part chamber 246 for the battery 234 illustrated in FIGS. 21 and 22. The closure element 263 is of a width 271 measured perpendicular to the joining face 172 which is smaller than the cover plate height 245. The width 271 less a ridge width 272 of a rear wall 273 of the closure element 263 bordering on the closure element 263 in a direction towards the top face 10 is larger than a battery thickness 274. As a result, it is possible to remove a spent battery 234 from the cover plate 7 without the latter having to be taken off the intermediate element 158. This is done by removing the closure element 263 from the orifice 262 thereby making the battery 234 accessible.

As briefly mentioned above, the part chamber 247 is used to house the switching element 237. To this end, it is bounded by side ridges 279 running symmetrically about the central axis 249, which are bounded by a cross ridge 276 extending between the external ridges 170 in the direction towards the part chamber 246 and a concave curved ridge 277 in a direction of the part chamber 248 for the light source 239 illustrated in FIG. 21. The part chamber 247, i.e. in particular the base plate 169 of the cover plate 7, has a recess 278 providing an orifice through the top face 10. However, this could also be arranged in a longitudinal end face 4 or transverse end face 5 of the cover plate 7 and/or the bottom plate 6, as is the case with the orifice 262 arranged in the region of the longitudinal end face 4.

The switching element 237 co-operates with the recess 278 of an operating element 279, in particular a shoulder 280 of the operating element 279, projecting through it. This shoulder 280 projects above a bottom face 281 running in a direction opposite the switching element 237 approximately parallel with the top face 10. The external dimensions of this bottom face 281 are larger than the cross-section dimensions of the recess 278 so that the operating element 279 is prevented from moving out from the recess 278. Arranged parallel with the bottom face 281 running from the bottom face 281 in the direction opposite the shoulder 280 is an operating face 282 which faces the switching element 237. When the switching element 237 is operated, a pressure is exerted via a pushing surface 283 of the operating element 279 in a plane more or less parallel with the top face 10 so that the pressure is transferred to the switching element 237, thereby operating it. The operating element 279 may be provided in the form of a button or a switch and in the case of the latter pressure is again applied to the pushing surface 283 and on to the operating element 279 in order to switch the switching element 237 off again.

As already mentioned, the part chamber 248 is used to house the light source 239. As can be seen more clearly from FIG. 22, it has a retaining collar 284 of a diameter 285. Perpendicular to the diameter 285, the retaining collar 284 is of a collar width 286. The retaining collar 285 matches a retaining groove 287 arranged in the part chamber 248 so that the light source 239 or the entire lighting device 221 is prevented from moving in a direction towards the central axis 249. The light source 239 projects through another recess 288 arranged in the transverse end face 5 of the cover plate 7, in particular the external ridge 170. A conical light beam is emitted or projected from the light source 239 onto a surface to be illuminated in such a way that it illuminates the region of the writing tip 173 of the writing instrument 128. Alternatively, however, the working region of another implement, for example a screwdriver, can also be arranged in the light beam, preferably in the ready-to-use position.

Alternatively, it is also possible to mount the lighting device 221 either as a whole or partly, for example the light source 239, by means of a pivot bearing 164 or on a pivotable implement 9 so that it is pivotable in the housing body 1. Furthermore, the lighting device 221 might not have a battery 234 and instead a solar cell arrangement or a coupling device could be provided on the housing body 1, in which an electrical contact is inserted so as to provide an external supply of power to the light source 238, so to speak.

Clearly, the various operating modes described above could also be designed as a housing body 1 provided as a flat-design storage case.

Figure 23:
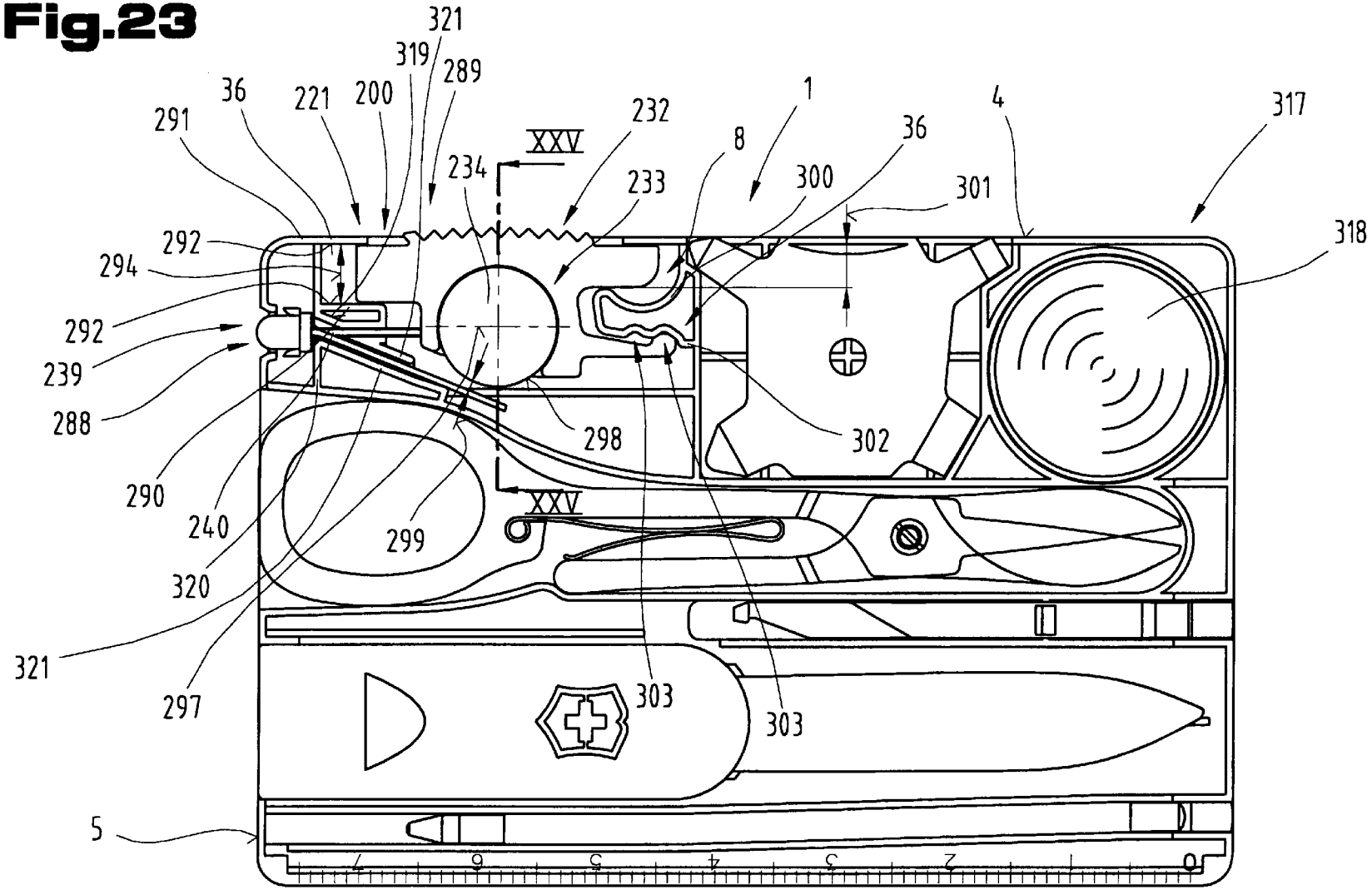
FIG. 23 is another embodiment of an implement holder, specifically designed as a housing body in the form of a flat storage case, seen in a plan view.
Figure 24:
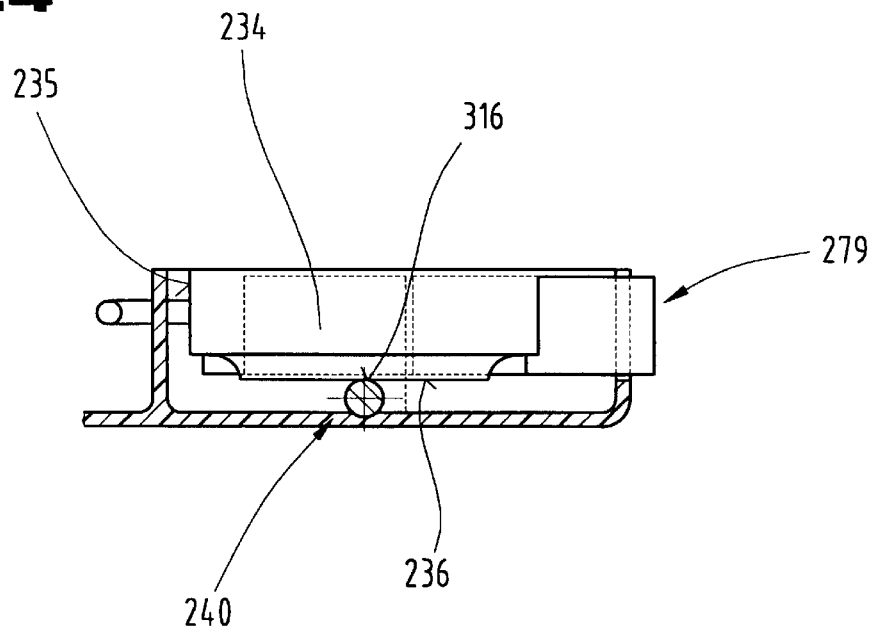
FIG. 24 is a part area of the implement holder proposed by the invention, in particular an operating element, seen in a plan view.
Figure 25:
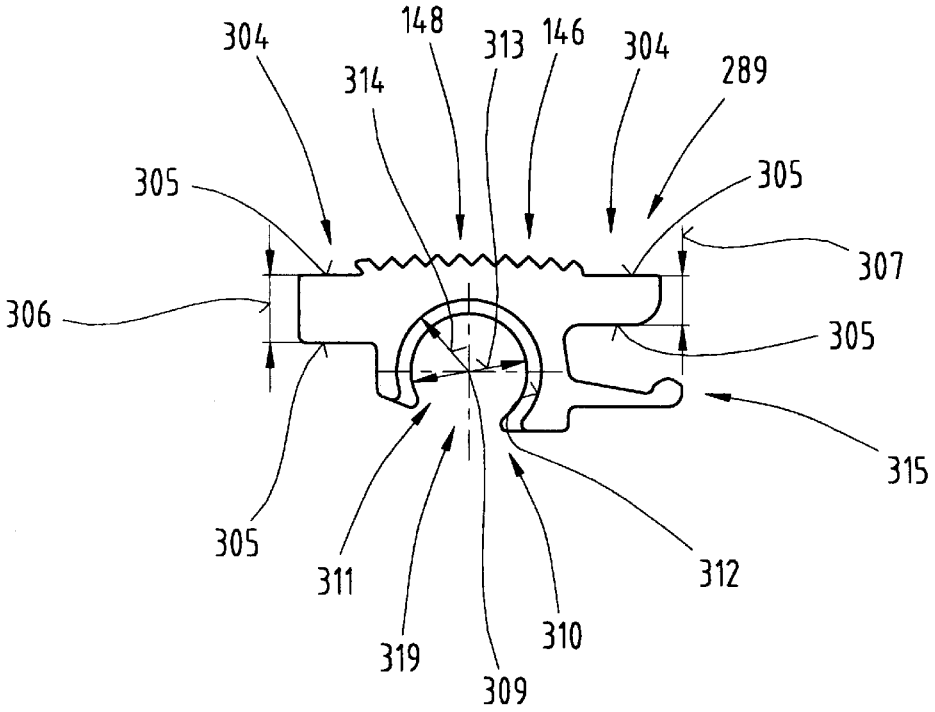
FIG. 25 shows the operating element, in section along the lines XXV—XXV of FIG. 23.

FIGS. 23 to 25, which will be described together, illustrate another embodiment of the implement holder proposed by the invention, which again has a housing body 1. This housing body 1 designed as a flat-shaped storage case has a lighting device 221 with a light source 239 and a power supply and/or switching device 232. This consists of a power source 233 and an operating element 289, wherein the energy source, in particular a battery 234, is arranged in the operating element 289.

The lighting device 221 is arranged in at least one housing compartment 8 of the housing body 1. A guide device 200 for the operating element 289 is provided in this housing compartment 8. It is formed by ridges 36, the receiving body 1 having an inner ridge 290 in a region adjacent to the light source 239 running parallel with an external ridge 291 of the housing body 1. An internal face 292 of the external ridge 291 facing the inner ridge 290 is spaced at a distance 294 measured from an internal face 293 of the inner ridge 290 which faces it parallel with the transverse end face 5. The inner ridge 290 is bounded by a cross ridge 295 running parallel with the transverse end face 5 in a direction towards the light source 239. It has a through-hole 296 through which conductor pins 240 of the light source 234 project.

Accordingly, the light source 239 is arranged with the light part in an intermediate region between the transverse end face 5 and the cross ridge 295 and projects through a recess 288 arranged in the transverse end face 5. A conductor pin 240 running parallel with the longitudinal end face 4 of the housing body 1 also extends so that it coincides more or less with a central axis 297 of the battery 234.

The second conductor pin 240 runs at an incline to the central axis 297 and to the first conductor pin 240 so that when the light source 239 is in the non-activated state this conductor pin 240 extending at an angle is spaced at a distance 299 from a circular external face 298 of the battery 234. In an end region of the guide device 200 remote from the light source 239, a curved ridge 300 runs from the internal face 292 of the external ridge 291, which is spaced apart from the internal face 292 of the external ridge 291 in a region facing the light source 239 by a distance 301.

Running from the curved ridge 300 in a direction opposite the external ridge 291 is another ridge 36, designed as a locating ridge 302. It has one or more locating recesses 303 which are concave in shape in a direction towards the curved ridge 300. The operating element 289, which is illustrated in detail in FIG. 25, has a gripping element 146, which in turn has recesses 148 making it easier to handle the operating element 289. Guide projections 304 adjoining the gripping element 146 extend in opposing directions.

One guide projection 304 is bounded by guide surfaces 305 spaced apart from one another by a guide width 306. The guide width 306 is slightly smaller than the distance 294. The other guide projection 304 also has guide surfaces 305, which are spaced apart from one another by a guide width 307 which is the same as or smaller than the distance 301. The operating element 289 has a compartment 308 for the power source 233, in particular the battery 234. The compartment 308 is formed by means of a shoulder 310 running concentrically about a centre point 309, which is bounded in a direction towards the centre point 309 by a circular bore 311. In a direction opposite the curved bore 311, the shoulder 310 is bounded by a shoulder face 312 running concentrically about the centre point 309. The bore 311 is of a bore diameter 313 and the shoulder 310 runs in a shoulder radius 314 about the centre point 309. Twice the shoulder radius 314 is greater than the bore diameter 313.

The operating element 289 has another locating projection 315, which is of an elastically resilient design and co-operates with the locating recesses 303. As the guide surfaces 305 of the guide device 200 guide the operating element 289 laterally, a conductor pin 240 forms a height guide surface 316 which simultaneously provides a contact surface for a pole surface 236 of the battery 234. If the operating element 289 is pushed in a direction towards the light source 239, the guide surfaces 305 slide against the internal faces 292 of the inner ridge 290 and the external ridge 291 and the curved ridge 300. Simultaneously, the locating projection 315 is moved out from a first locating recess 303 and the operating element 289 is pushed, causing a conductor pin 240 to slide along the pole surface 236. When a second pole surface 235 reaches the second conductor pin 240, which extends at an angle to the central axis 297 as described above, the contact is closed and the light source 239 begins to illuminate. Simultaneously, the locating projection 315 engages in the other locating recess 303 thereby preventing the operating element 289 from inadvertently moving of its own accord.

The housing body 1 also has an optical element 317, which might be a magnifying glass 318 for example. However, it would also be possible to provide the housing body 1 with a compass.

In the same way as the other contact pin 228, the angled conductor pin 240 projects through an opening 319, arranged in an inner ridge 320 extending from the external ridge 291 parallel with the transverse end face 5. The inner ridge 320 spaced apart from the transverse end face 5 has, on a face remote from the transverse end face 5, two guide ridges 321 which run parallel with one another and parallel with the angled conductor pin 240. This provides an easy means of replacing the light source 239, the conductor pins 240 of which run parallel with one another in the original state, i.e. as supplied. If the light source 239 is inserted through the recess 288 into the housing body 1, the two conductor pins 240 reach the opening 319. As one conductor pin 240 extends parallel and coinciding with the central axis 297, the second conductor pin 240 slides between the two guide ridges 321 thereby inclining it, so that the light source 239 is prevented from coming loose of its own accord.

Figures 26, 27, 28:
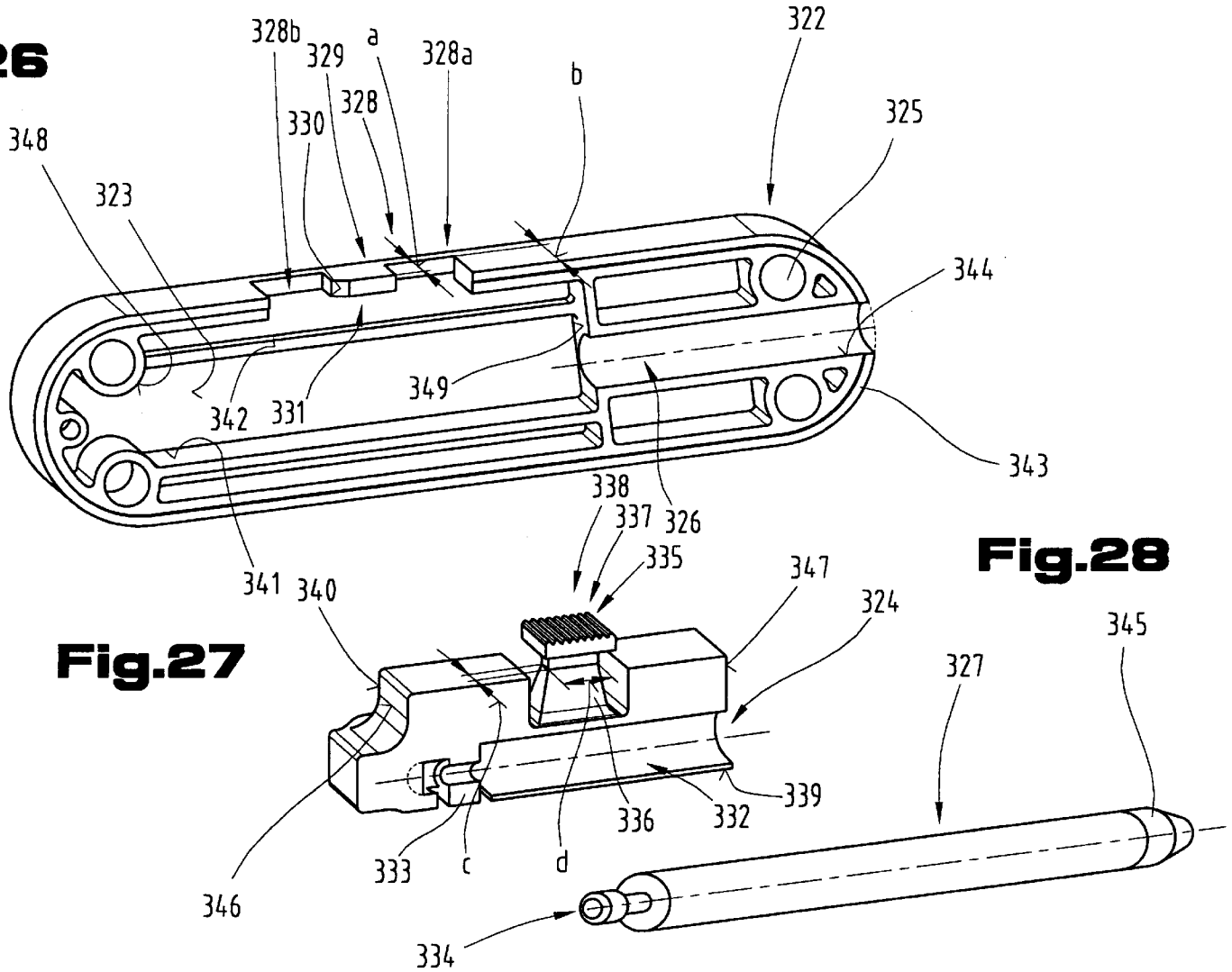
FIG. 26 shows a shell of a pocket knife according to the invention in an explosive view.
FIG. 27 shows a slide of a pocket knife according to the invention in an explosive view.
FIG. 28 shows a refill of a pocket knife according to the invention in an explosive view.

The shell 322 of a pocket knife according to the invention shown in FIGS. 26 to 28 is provided with a longitudinal slot 323 in which a slide 324 is displaceable in axial direction. The shell 322 made of plastic also comprises bores 325 which are provided for mounting not shown rivets for securing the shell 322 to an outer plate of the pocket knife. A conventional pocket knife comprises in a known manner two outer plates which are covered on the outside respectively by a shell 322 and central plates between which the functional elements are arranged. The rivets to be inserted into the bores 325 connect the individual plates and the functional elements arranged between the latter.

As can be seen in FIGS. 26 to 28 a recess 326 is arranged next to the longitudinal slot 323 in which a refill 327 is guided. The longitudinal slot 323 and the recess 326 are designed to be open on the inside of the shell 322 facing the functional elements of the pocket knife or the respective outer plate, so that on assembly a simple insertion of the slide 324 and the refill 327 is possible. On the upper narrow side of the shell 322 shown in FIG. 26 there is a opening 328 in which a cam 329 is formed in the centre. The cam 329 is provided with an inclined surface 330 on the side facing away from the recess 326. The depth a of the cam 329 is less than the depth b of the opening 328, so that with a shell 322 secured to the outer plate of the pocket knife a gap is formed between the cam 329 and the plate.

The slide 324 arranged displaceably in the longitudinal slot 323 comprises a substantially semi-shell-like mount 332 coaxial to the recess 326 of the shell 322, which also opens towards the inside of the shell 322 and in which the refill 327 is mounted. At the end of the mount 332 opposite the recess 326 an elastic restriction 333 is formed, which when the refill 327 is inserted grips a bolt-like end 334 formed thereon. Ends 334 of this kind are provided on commercially available refills 327 so that they can be taken advantage of and in this way an inexpensive manufacture can be achieved.

The slide 324, which is for example injection moulded from plastic, is also provided with an actuating element 335 with a flexible shaft 336 and an upper side 338 provided with a corrugated surface 337. The depth c of the flexible shaft 336 is slightly smaller than the width of the gap 331 so that on displacing the slide 324 the shaft 336 can be moved along the cam 329. The slide 324 is also provided with sliding surfaces 339, 340, which permit a low-friction and thereby almost wear-free sliding of the slide 324 along the sliding surfaces 341, 342 designed correspondingly on the shell 322. The perpendicular sliding surfaces 339 and 340 or 341 and 342 thus ensure guiding both in axial and transverse direction. A slightly projecting edging 343 of the shell 322 ensures a tight fit of the shell 322 against the respective outer plate of the pocket knife and at the same time provides the necessary play for the displacement of the slide 324. The edging 343 extends close to the externally open end face of the recess 326 into an inner shoulder 344 of the recess 326, which in the advanced position of the slide 324 or the refill 327 mounts a shoulder 345 formed on the refill 327. In this way when writing the refill 327 is guided particularly stably in radial direction.

The displacement of the slide 324 is restricted by stops 346 and 347 which are shaped according to the side walls 348 and 349 of the longitudinal slot 323. If the stop 347 lies against the wall 349 the actuating clement 335 is in the advanced end position 328*a*, whereas if the stop 326 is against the wall 348 the actuating element 335 is in the retracted end position 328*b*. The displacement of the slide 324 into one of the two end positions 328*a*, 328*b* is performed in that the actuating element 335 is pressed by slight bending in transverse direction to the level of the gap 331, so that it can be pushed by the latter along the cam 329 into the other end position 328*a*, 328*b* respectively. In order to facilitate the displacement of the slide 324 from the retracted end position 328*b*, i.e. with an inserted refill 327, into the advanced end position 328*a* the inclined surface 330 is provided, which facilitates the running of the shaft 336 of the actuating element 335. On moving the slide 324 from the advanced end position 328*a* into the retracted end position 328*b* however the actuating element 335 has to be bent further due to the absence of an inclined surface of the cam 329 in order to be guided along the latter, so that in this way the actuating element 335 can be secured in the advanced end position 328*a*, i.e. when writing. The width d of the shaft 336 of the actuating element 335 is such that the actuating element 335 is secured with a slightly clamping fit in the end positions 328*a*, 328*b*.

The pocket knife according to the invention is characterised by the function of a pen 327, which is integrated with simple assembly and inexpensive manufacture. In addition the refill 327 can be replaced easily so that practical handling is also taken into consideration.

The housing body 1, particularly the bottom plate 6 or the cover plate 7, can be made form plastic, in particular using an injection moulding process or an injection or stamping process. However, it may also be made from other materials, such as aluminium, wood, cardboard or other materials.

Clearly, it would also be possible to provide the housing body 1 with additional retaining members, such as projecting retaining noses or similar, for housing and storing credit cards, identification cards or possibly also cash.

It should be pointed out that individual details of embodiments, in particular those set out in the dependent claims, may also be regarded as the subject-matter of the invention in their own right. Furthermore, any detail of one embodiment can be combined with one or more other details from another embodiment. Moreover, WO 97/19856 is also cited as forming part of the contents of this disclosure.

Finally, it should also be pointed out that in order to provide a clearer understanding of the drawings, individual parts or parts of drawings, such as the joining ridges 155, 162 for example, are, to some extent, not illustrated to scale, e.g. are enlarged out of proportion, and that individual embodiment details can be combined with one another in different ways.

LIST OF REFERENCE NUMBERS

1. Housing body
2. Width
3. Length

4. Longitudinal end face
5. Transverse end face
6. Bottom plate
7. Cover plate
8. Housing compartment
9. Implement
10. Top face
11. Inclined face
12. Angle of inclination
13. Scale
14. Rule
15. Knife
16. Knife blade
17. Knife handle
18. Joining face
19. Bottom face
20. Recessed depression
21. Gripping surface
22. File
23. Compartment opening
24. Recess
25. File handle
26. Clippers
27. Clipper handle
28. Hinged plate
29. Corner region
30. Hinge pin
31. Hinge mounting
32. Cam track
33. Tweezers
34. Tooth pick
35. Thickness
36. Ridge
37. Recessed depression for the knife
38. Recessed depression for the needle
39. Recessed depression for the file
40. Recessed depression for the tweezers
41. Recessed depression for the clippers
42. Recessed depression for the tooth pick
43. Recessed depression for the ball-point pen
44. Part ridge
45. Depression width
46. Needle
47. Curved face
48. Stop ridge
49. Clamping ridge
50. Clamping surface
51. Bottom face
52. Height
53. Depression base
54. Retaining shoulder
55. Centring ridge
56. Width of free region
57. Free region
58. Depression width
59. Centring ridge
60. Centring ridge
61. Depth
62. Stop ridge
63. Clamping ridge
64. Centring ridge height
65. Ridge height
66. Longitudinal ridge
67. Ridge length
68. Longitudinal ridge
69. Cross ridge
70. Depression width
71. Clamping ridge
72. Centring ridge
73. Corner region
74. Centring projection
75. Internal face
76. Height
77. Opening
78. Centring compartment
79. Longitudinal ridge
80. Longitudinal ridge
81. Top face
82. Base face
83. Height
84. Depth
85. Ridge height
86. Limiting ridge
87. Moulding
88. Peripheral ridge
89. Radius of curvature
90. Part ridge
91. Joining ridge
92. Guide ridge
93. Internal height
94. Wall thickness
95. Thickness
96. Joining ridge
97. Joining ridge
98. Width
99. Height
100. Inclined face
101. Multi-purpose tool
102. Side ridge
103. Cross ridge
104. Distance
105. Wider section
106. Main body
107. Tool
108. Screwdriver
109. Distance
110. Distance
Ill. Thickness
112. Internal face
113. Inner ridge
114. Top face
115. Height
116. Moulding
117. Recess
118. Bore
119. Diameter
120. Retaining ridge
121. Internal face
122. Distance
123. Distance
124. Top face
125. Distance
126. Limiting ridge
127. End edge
128. Writing instrument
129. Ball-point pen
130. Positioning and/or locating device
131. Operating element
132. Longitudinal ridge
133. Central axis
1 34. Compartment
135. Retaining jaw
136. Locating projection
137. Bore

138. Diameter
139. Housing compartment
140. Compartment diameter
141. Diameter
142. External diameter
143. End face
144. Centring device
145. Diameter
146. Gripping element
147. Slit
148. Recess
149. Guide element
150. Locating lever
151. Ridge
152. Locating recess
153. Gripping piece
154. Depth
155. Length
156. Length
157. Pocket knife
158. Intermediate element
159. Distance
160. Element
161. Length
162. Intermediate space
163. Joining element
164. Pivot bearing
165. External face
166. Collar
167. Collar diameter
168. Diameter
169. Base plate
170. External ridge
171. Bottom plate height
172. Joining face
173. Writing tip
174. Compartment axis
175. Retaining device
176. Clamping ridge
177. Clamping surface
178. Distance
179. Compartment face
180. Distance
181. Radius
182. Joining piece
183. Locating barrel
184. Radius
185. Guide part
186. Guide ridge
187. Lateral guide surface
188. Top face
189. Height
190. Height guide surface
191. Width
192. Guide ridge width
193. Total width
194. Ridge
195. Free region
196. Ridge width
197. Ridge thickness
198. Width
199. Length
200. Guide device
201. Height guide surface
202. Guide section
203. Stop surface
204. Recess
205. Guide ledge
206. Internal side face
207. Bottom face
208. Ledge width
209. Side face
210. Bottom face
211. Radius
212. End face
213. Transverse end face
214. Length
215. End face
216. Width
217. Longitudinal end face
218. Distance
219. Width
220. Top face
221. Lighting device
222. Base element
223. Bottom plate
224. Conductor plate
225. Contact plate
226. Contact plate
227. Distance
228. Contact pin
229. Contact surface
230. Internal face
231. Distance
232. Power supply and/or switching device
233. Power source
234. Battery
235. Pole surface
236. Pole surface
237. Switching element
238. Cover
239. Light source
240. Conductor pin
241. Plane
242. Moulding
243. Housing region
244. Housing region
245. Cover plate height
246. Part chamber
247. Part chamber
248. Part chamber
249. Central axis
250. Joining recess
251. Central axis
252. Distance
253. Central axis
254. Centre point
255. Limiting ridge
256. Radius
257. Battery diameter
258. Inner ridge
259. Distance
260. Projection
261. Height
262. Orifice
263. Closure clement
264. Annular ridge
265. Side ridge
266. Moulding
267. Width
268. Side ridge
269. Cross ridge
270. Part chamber
271. Width

272. Ridge width
273. Rear wall
274. Battery thickness
275. Side ridge
276. Cross ridge
277. Curved ridge
278. Recess
279. Operating element
280. Shoulder
281. Bottom face
282. Operating surface
283. Pushing surface
284. Retaining collar
285. Diameter
286. Collar width
287. Retaining groove
288. Recess
289. Operating element
290. Inner ridge
291. External ridge
292. Internal face
293. Internal face
294. Distance
295. Cross ridge
296. Through-hole
297. Central axis
298. External face
299. Distance
300. Curved ridge
301. Distance
302. Locating ridge
303. Locating recess
304. Guide projection
305. Guide surface
306. Guide width
307. Guide width
308. Compartment
309. Centre point
310. Shoulder
311. Bore
312. Shoulder face
313. Bore diameter
314. Shoulder radius
315. Locating projection
316. Height guide surface
317. Element
318. Magnifying glass
319. Orifice
320. Inner ridge
321. Guide ridge
322. Shell
323. Longitudinal slot
324. Slide
325. Bore
326. Recess
327. Refill
328. Opening
328*a*. End position
328*b* End position
329. Cam
330. Inclined surface
331. Gap
332. Mount
333. Restriction
334. End
335. Actuating element
336. Shaft
337. Corrugated surface
338. Upper side
339. Sliding surface
340. Sliding surface
341. Sliding surface
342. Sliding surface
343. Edging
344. Inner shoulder
345. Shoulder
346. Stop
347. Stop
348. Wall
349. Wall

What is claimed is:

1. A holder for implements, comprising:

a housing body defining a plurality of housing compartments therein including at least a writing implement housing compartment and an additional housing compartment;

a writing implement disposed in the writing implement housing compartment and an additional implement disposed in the additional housing compartment, the writing implement being movable in an axial direction between a stowed position inside the housing body and an extended position partially protruding out from the housing body such that the housing body forms a gripping part therefor; and an operating element connected to the writing implement, the operating element having an elastically deformable portion that extends through a slot formed in the housing body and terminates in a gripping element outside the housing body, the slot extending parallel to the axial direction and having a locating recess comprising a widened portion of the slot at each opposite end of the slot, the deformable portion being arranged to be elastically biased into each of the locating recesses to fix the writing implement in the stowed and extended positions, whereby pressing the gripping element laterally disengages the deformable portion of the operating element from the locating recess so that the writing implement can be extended or stowed.

2. The holder of claim 1, wherein the additional implement comprises a knife.

3. The holder of claim 1, wherein the housing body comprises a bottom plate and a cover plate arranged parallel to each other.

4. The holder of claim 3 wherein the housing body further comprises an intermediate element disposed between the bottom and cover plates.

5. The holder of claim 4 wherein the writing implement housing compartment is formed in one of the bottom and cover plates.

6. The holder of claim 1, further comprising a lighting device arranged in the housing body.

7. The holder of claim 6, wherein the lighting device is arranged relative to the writing implement such that when the writing implement is in the extended position a tip of the writing implement is in at least a peripheral region of a light beam emitted by the lighting device.

8. The holder of claim 6, wherein the lighting device includes a power supply.

9. The holder of claim 6 wherein the lighting device includes a switching device.

10. The holder of claim 1, wherein a portion of one of the bottom and cover plates is hingedly connected to the housing body so as to be pivotable relative thereto.

11. The holder of claim 10, wherein said portion that is hingedly connected to the housing body is arranged so as to pivot in a plane defined by the plate of which said portion forms a part.

12. The holder of claim 1 wherein the housing body defines a cam positioned at the slot adjacent to one of the locating recesses such that axial movement of the operating element toward the other locating recess causes the deformable portion to engage the cam, the cam being shaped to urge the deformable portion laterally to disengage from the locating recess.

13. A holder for implements, comprising:

a housing body defining a first writing implement housing compartment and a second writing implement housing compartment therein;

a writing implement for storage in the first writing implement housing compartment; and wherein the second writing implement housing compartment extends into the housing body along a longitudinal direction and has a depth in the longitudinal direction such that when the writing implement is fully inserted into the second writing implement housing compartment in the longitudinal direction a portion of the writing implement protrudes out beyond a periphery of the housing compartment such that the housing body forms a gripping part therefor.

14. The holder of claim 13 wherein the housing body further comprises an additional housing compartment having an additional implement therein.

15. The holder of claim 13, further comprising an operating element positioned to be connected to the writing implement when the writing implement is inserted into the first writing implement housing compartment, the operating element having a portion that extends through a slot formed in the housing body and terminates in a gripping element outside the housing body, the slot extending parallel to an axis of the writing implement and having a locating recess comprising a widened portion of the slot at each opposite end of the slot.

16. A holder for implements, comprising:

a housing body defining a plurality of housing compartments therein including at least a writing implement housing compartment and an additional housing compartment, the housing body being formed by at least a bottom plate and a cover plate;

a writing implement disposed in the writing implement housing compartment and an additional implement disposed in the additional housing compartment, the writing implement being movable between a stowed position inside the housing body and an extended position partially protruding out from the housing body such that the housing body forms a gripping part therefor; and wherein a portion of one of the bottom and cover plates comprises a door that is hingedly connected to the housing body so as to be pivotable relative thereto.

17. The holder of claim 16, wherein the door is hingedly connected to the housing body by a hinge pin in a hinge mounting.

18. A holder for implements, comprising:

a housing body defining at least a writing implement housing compartment therein;

a writing implement disposed in the writing implement housing compartment, the writing implement being movable between a stowed position inside the housing body and an extended position in which a tip of the writing implement is protruding out from the housing body; and a lighting device arranged in the housing body, the lighting device being arranged relative to the writing implement such that when the writing implement is in the extended position the tip of the writing implement is in at least a peripheral region of a light beam emitted by the lighting device.

19. The holder of claim 18 further comprising an additional implement disposed in an additional housing compartment in the housing body.

20. A pocket tool comprising:

a housing body comprising at least a bottom plate and a cover plate opposing each other;

a tool arranged in a tool housing compartment defined in the housing body, the tool being pivotably mounted in the housing body and having a biasing device for urging the tool toward one of an extended and a retracted position;

a writing implement disposed in a writing implement housing compartment defined in the housing body, the writing implement being movable in an axial direction between a stowed position inside the housing body and an extended position partially protruding out from the housing body such that the housing body forms a gripping part therefor; and an operating element connected to the writing implement, the operating element having an elastically deformable portion that extends through a slot formed in the housing body and terminates in a gripping element outside the housing body, the slot extending parallel to the axial direction and having a locating recess comprising a widened portion of the slot at each opposite end of the slot, the deformable portion being arranged to be elastically biased into each of the locating recesses to fix the writing implement in the stowed and extended positions.

* * * * *